US011638456B1

(12) United States Patent
Matteucci et al.

(10) Patent No.: US 11,638,456 B1
(45) Date of Patent: May 2, 2023

(54) DISPERSING HELMET SAFETY SYSTEM AND METHOD

(71) Applicants: Rose Matteucci, Castro Valley, CA (US); Carlo Matteucci, Castro Valley, CA (US)

(72) Inventors: Rose Matteucci, Castro Valley, CA (US); Carlo Matteucci, Castro Valley, CA (US)

( * ) Notice: Subject to any disclaimer, the term of this patent is extended or adjusted under 35 U.S.C. 154(b) by 0 days.

(21) Appl. No.: 17/582,406

(22) Filed: Jan. 24, 2022

Related U.S. Application Data

(63) Continuation of application No. 17/217,927, filed on Mar. 30, 2021, now Pat. No. 11,229,254.

(60) Provisional application No. 63/003,156, filed on Mar. 31, 2020, provisional application No. 63/003,132, filed on Mar. 31, 2020, provisional application No. 63/003,263, filed on Mar. 31, 2020.

(51) Int. Cl.
*A42B 3/06* (2006.01)

(52) U.S. Cl.
CPC ..... *A42B 3/063* (2013.01)

(58) Field of Classification Search
CPC ..... A42B 3/063; A42B 3/064; A42B 3/125
See application file for complete search history.

(56) References Cited

U.S. PATENT DOCUMENTS

| | | | | |
|---|---|---|---|---|
| 2,866,977 | A * | 1/1959 | Finken | A42B 3/14 2/416 |
| 3,735,418 | A * | 5/1973 | Kavanagh | A42B 3/14 2/416 |
| 3,872,511 | A | 3/1975 | Nichols | |
| 5,012,533 | A | 5/1991 | Raffler | |
| 5,204,998 | A | 4/1993 | Liu | |
| 5,515,546 | A | 5/1996 | Shifrin | |
| 5,544,367 | A | 8/1996 | March, II | |
| 6,154,889 | A | 12/2000 | Moore, III | |
| 9,572,390 | B1 * | 2/2017 | Simpson | A42B 3/125 |
| 9,642,410 | B2 | 5/2017 | Grice | |
| 11,229,254 | B1 * | 1/2022 | Matteucci | A42B 3/20 |
| 2015/0164174 | A1 * | 6/2015 | West | A42B 3/069 2/414 |
| 2017/0065018 | A1 | 3/2017 | Lindsay | |
| 2017/0303620 | A1 | 10/2017 | Sicking | |
| 2020/0085128 | A1 * | 3/2020 | Coyle | A42B 3/064 |
| 2020/0146385 | A1 * | 5/2020 | Young | A42B 3/064 |

* cited by examiner

*Primary Examiner* — Tajash D Patel
(74) *Attorney, Agent, or Firm* — Roark IP

(57) ABSTRACT

A system and method for a protection helmet which has exterior moveable tiles to move upon impact and then retract to their original placements. The system prolongs the impact time by de-accelerating it and minimizing its damaging effects by spreading out the impact force over a larger surface area. A system and method for a helmet's face mask to absorb impact and return back to its original state whether impacted on its bars, interior/exterior assembly, or any part of the face mask. A system and method for a football helmet's padding to be multi-layered and have multiple ancillary cavities that compress and retract back to their original state.

10 Claims, 25 Drawing Sheets

100

100

100

100

DISPERSING HELMET SAFETY SYSTEM AND METHOD

PRIORITY

This application claims priority to U.S. patent application Ser. No. 17/217,927 with a filing date of Mar. 30, 2021; which claims priority to U.S. Provisional Patent Application 63/003,132, filed on Mar. 31, 2020; U.S. Provisional Patent Application 63/003,156, filed on Mar. 31, 2020; and U.S. Provisional Patent Application 63/003,263, filed on Mar. 31, 2020. Each of these applications are hereby incorporated herein in their entireties.

TECHNICAL FIELD

The present invention relates to protective gear, and in particular, for a helmet, helmet face mask and helmet padding.

BACKGROUND

Helmets and other protective headgear are commonly utilized to protect a wearer's head from injury. Typically, helmets are designed specifically for the particular sport or activity. Numerous sports, such as American football, hockey, and lacrosse, require players to wear helmets.

SUMMARY OF THE DISCLOSURE

Aspects of the disclosure include a helmet comprising: a shell having a plurality of holes; a plurality of tiles mounted on the exterior of the shell tethered by elastic cords through the plurality of holes to the interior of the shell; and wherein the tiles are capable of moving from their original position to a second position upon impact and being retracted back to the original position by the elastic cords.

Further aspects of the disclosure include a method of providing progressive retractable padding for a helmet comprising: impact a plurality of tiles mounted on the exterior of a shell tethered by elastic cords through a plurality of holes to the interior of the shell causing a plurality of impacted tiles at an impact point to move out of a predetermined position and deform in shape from an original shape; and retract the plurality of impacted tiles back through the elastic cords to the predetermined position and reform the tiles back the original shape.

Further aspects of the disclosure include a helmet comprising: an exterior padding system comprising: a shell having a plurality of holes; a plurality of tiles mounted on the exterior of the shell tethered by elastic cords through the plurality of holes to the interior of the shell; and wherein the tiles are capable of moving from their original position to a second position upon impact and being retracted back to the original position by the elastic cords; a face mask assembly comprising: a face mask having a front section, two middle sections and two rear sections having protection bars forming a cage; wherein the front and middle sections are connected by a first set of springs inside a first set of the protection bars; wherein the middle and rear sections are connected by a second set of springs inside a second set of the protection bars; and the front section capable of collapsing upon the impact into the middle section and the middle section capable of collapsing into the rear section; an interior padding system comprising: a first padding layer having head stabilizing components with a plurality of flexible compression components; and a second padding layer mounted on the interior of the shell and having a plurality of flexible mechanisms configured to correspondingly mate with each of the plurality of flexible compression components. Further aspects of the disclosure include a helmet system comprising: a first padding layer made of a stretchy material and configured to be in hugging contact with a user's head, wherein the first padding layer has a plurality of user head stabilizing bands each having flexible compression components; and a shell having a second inner wall padding layer affixed to the interior of the shall and made up of flexible mechanisms, wherein the flexible mechanisms are in contact with the flexible compression components to provide deflection from any impact forces received at the shell.

BRIEF DESCRIPTION OF THE DRAWINGS

Each of the figures below is provided for the purpose of illustration and description only and not as a definition of the limits of the claims. Note that the same reference items may be used in different figures and embodiments to indicate the same part and/or dimension.

DETAILED DESCRIPTION

Today's standard helmets have changed very little since John T. Riddell introduced the first plastic American football helmet in 1939. The present disclosure relates generally to protective headgear (e.g., football helmet) and in particular a system and method for allowing a helmet tiler layer covering, face mask and helmet padding to expand on impact and then retract to the original state. The disclosed system and method improves the safety of helmets by addressing not just the jarring hits and tackles in football that can lead to traumatic brain injury but also the less visibly intense but numerous sub-concussive hits that players take many times over the course of a game that often lead to long term damage. In addition, the system and method address the problem of "rotational hits". Rotational hits are hits to the side of a player's helmet where players are also vulnerable causing their heads or necks to snap or twist around on impact.

Dispersive Helmet

Figure 1:
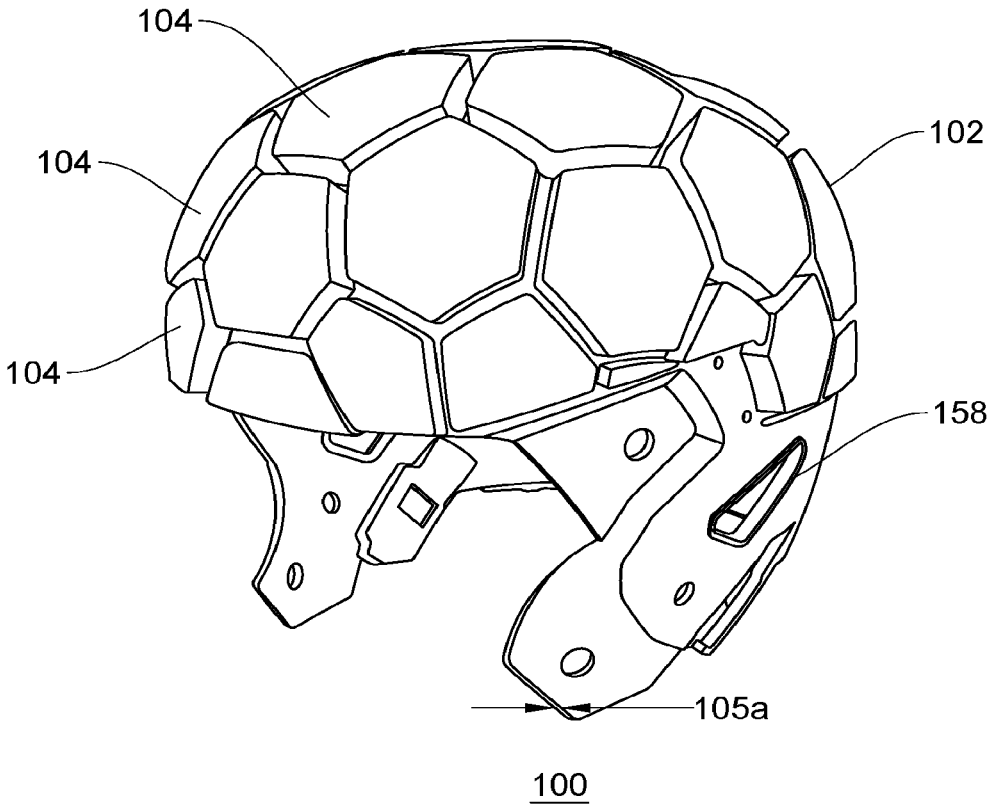
FIG. 1 illustrates a perspective view of helmet 100 with tile layer 102 covering.
Figure 2:
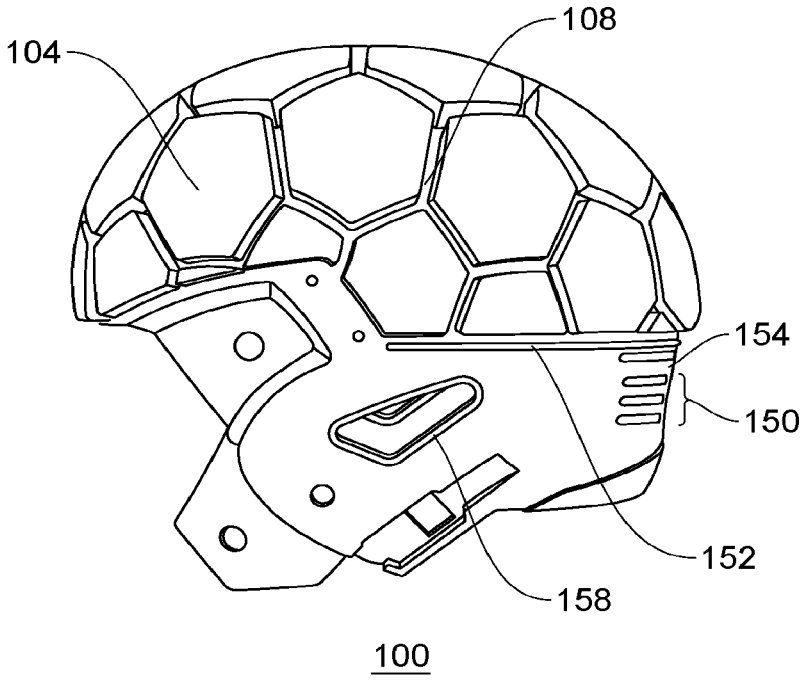
FIG. 2 depicts a side elevation view of helmet 100 with tile layer 102 covering.
Figure 3:
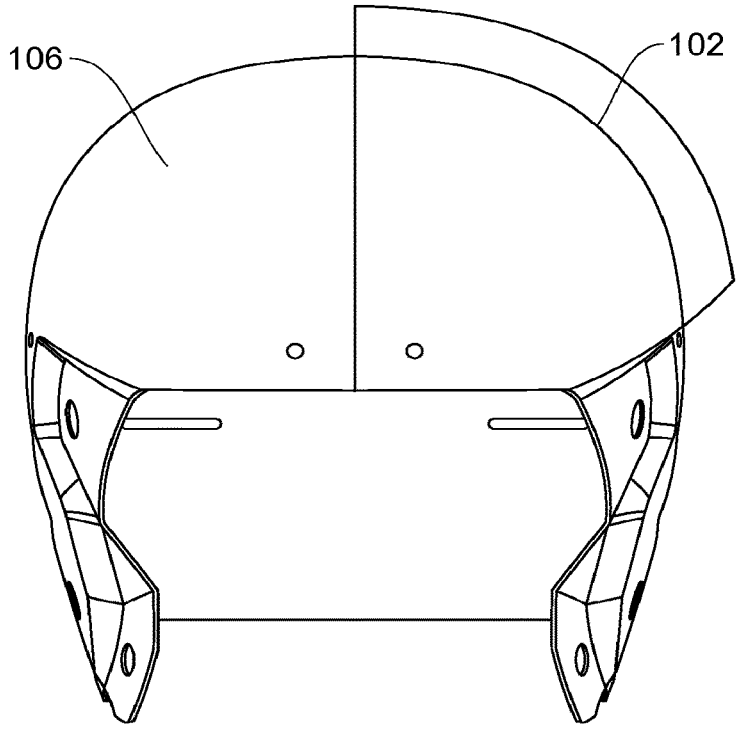
FIG. 3 depicts a front, cut away view showing the helmet 100 with and without tile layer 102 covering.
Figure 4:
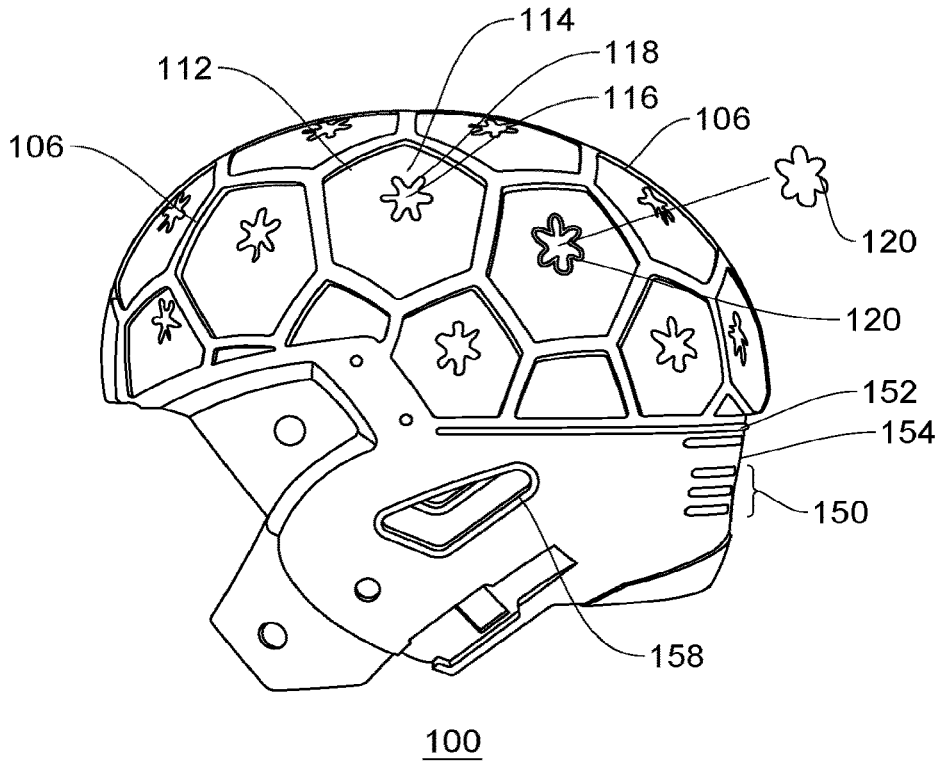
FIG. 4 shows a side elevational view of the helmet 100 without tile layer 102 covering.
Figure 5:
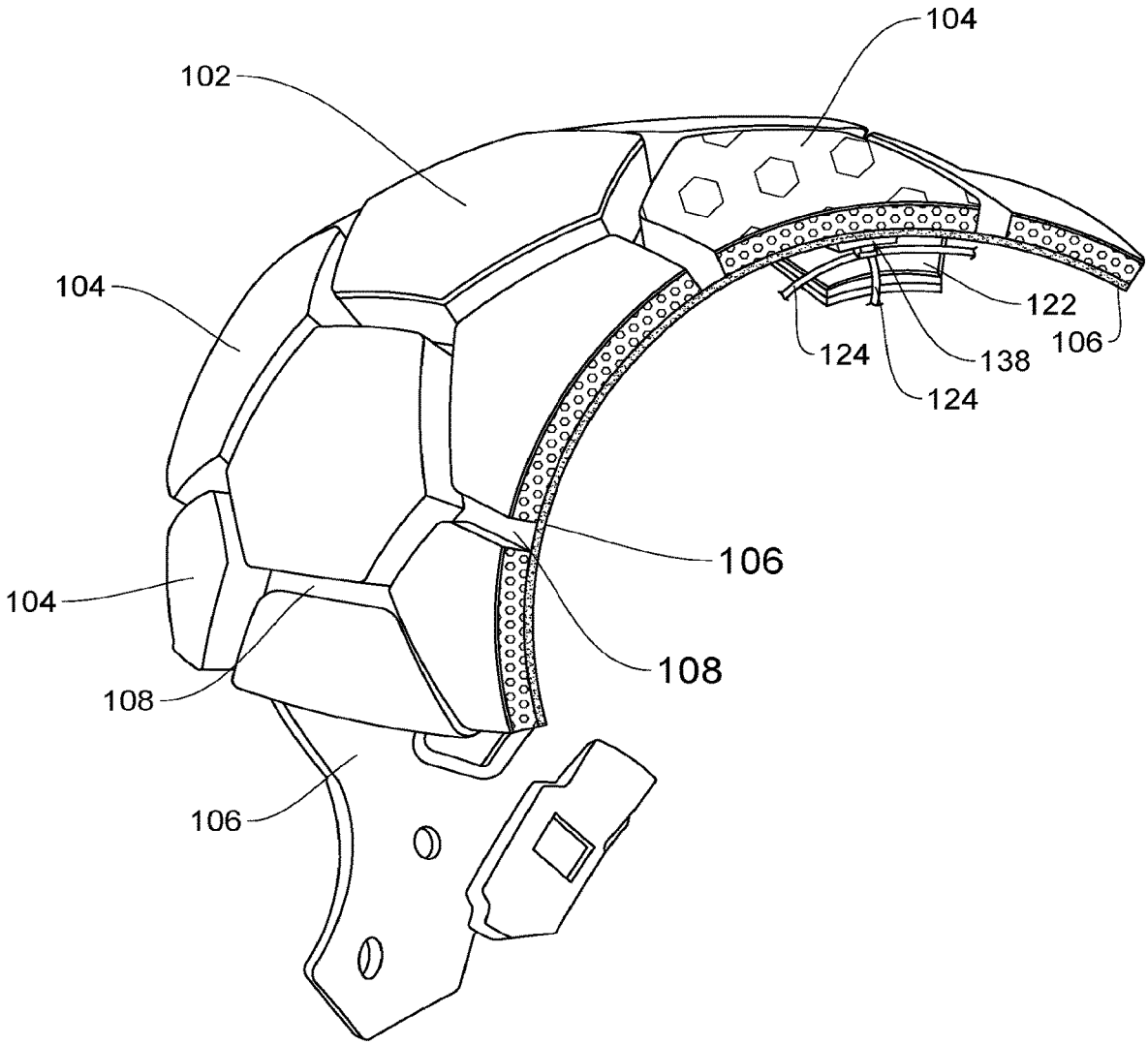
FIG. 5 shows a side, cross-sectional view of the helmet 100 with tile layer 102 covering.

FIGS. 1-5 depict various views of a dispersive helmet 100 with and without tile layer coverings. FIG. 1 depicts a perspective view of helmet 100 with tile layer 102 covering in place, FIG. 2 depicts a side elevation view with tile layer 102 covering, FIG. 3 depicts a front, cut away view showing the helmet 100 with and without a tile layer 102 covering, FIG. 4 shows a side elevational view without a tile layer 102 covering and FIG. 5 shows a side, cross-sectional view with a tile layer 102 covering. The helmet 100 has tile layer 102 forming an exterior covering (or outer contour) of the helmet 100. The tile layer 102 is made up of an intricate network of tiles 104 forming a retractable crumple zone mounted on a hard base layer shell 106. Shell 106 has a thickness (reference item 106*a*) throughout the shell 106 in a range of approximately 2.00 millimeters (mm) to approximately 3.25 mm with approximately 3.175 mm being the typical thickness. The underlying shell 106 can be a dense durometer tested tensile strength polymer composite which is both rigid and flexible. This polymer composite may be ethylene-vinyl acetate (EVA) or polyester urethane and have a tensile strength of approximately 124 to approximately 1600 pounds per square inch (psi) or greater.

Tile layer 102 is formed from interlocking tiles 104 constructed from a polycarbonate. The tile layer 102 allows head-to-helmet hits to "slide off each other" while the dense shell 106 is capable of slight compression due to its superior tensile strength. The tiles 104 are configured to absorb both pushing and pulling forces. The tiles 104 have the ability to scatter and expand on impact while spreading out like a ripple of water to disperse impact forces. Upon impact, the tiles 104 are configured to collide into each other in a progressive relay (or domino) effect of increasing resistance from an initial impact to any part of the exterior of the helmet 100 in a chain reaction of resistance to the force of the initial impact. The colliding tiles 104 are progressively slowed down and then each tile 104 is immediately retracted to its original position on the shell 106 and also back into the original tile shape. The system and method disclosed herein extends the length of time of impact and spreads the distribution of impact force over a large surface area of the helmet 100. Between the tiles 104 on layer 102 are tile separation spaces 108. The tile separation spaces 108 surround each of the tiles 104 and are recessed from the outer contour in the tile layer 102. Tile separation spaces 108 may act as a de-accelerant to slow down the tiles 104 by the fact that they are filled with cushioning air. In another embodiment, the tile separation spaces 108 can be filled with shock absorbent components instead of just air. These shock absorbent components can be rubber or plastic bumpers, springs, gel, or gel packers.

Each tile 104 is able to expand and contract and physically move in 360 degrees of direction in reaction to an impact force. The tiles 104 can be configured to move both individually and independently of each other and the shell 106. In an alternative embodiment, the tiles may move as a collection of tiles formed into a group or a plurality of groups. Some of the groups of tiles 104 may remain stationary while another group is capable of movement across the surface of the shell 106.

FIG. 3 illustrates a front view of the helmet 100 with a cutaway portion showing the difference in contour of the outer part of the helmet without the tile layer 102 in place. The tile layer 102 and tiles 104 can have sensors (e.g., microchips, Internet of Things (IoT)) with wireless communications to communicate impact levels to a remote party. These tiles 104 can wirelessly communicate data such as the structural integrity of each of the tiles 104, tile 104 condition, position, integrity, durability, impact points, frequency of impacts in any given location, measured force in pounds per square inch (psi) of impact and number of impacts overall. In addition, impact data on the helmet shell, the interior padding, the face mask and/or the entire helmet as a whole as well may be measured. In addition to damage reports, data such as weather conditions, temperature weather ambient, atmospheric pressure, and interior or exterior of the shell temperature may be wirelessly communicated. Data such as player performance, health, concussion status, heart rate, pulse, beats and/or breaths per minute, oxygen, hydration, internal body temperature, external body temperature, facial, eye, ocular, muscle, visual dilation recognition, motor functions analysis, and nervous system information as well may be wirelessly communicated. In another embodiment, reported data may include play calling, game statistics, performance, sacks, hits, tackles, contact, throws, catches, runs, touchdowns, yards, yards gained, first down markers, real time game statistics, and augmented reality information.

Figure 13:
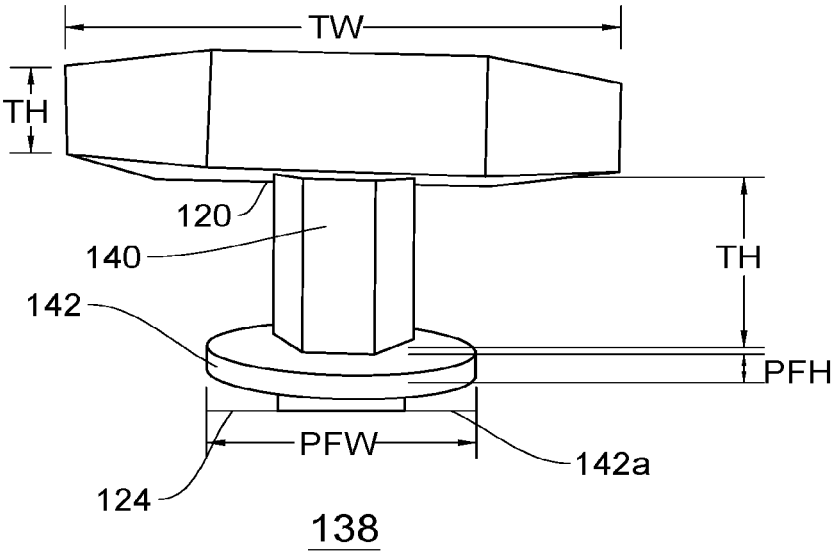
FIG. 13 shows a side view of a tile assembly 138 having a tile 104, stem 140, and presser foot 142.

FIG. 4 shows the shell 106 without the tile layer 102 in place. Indentations 112 in the shell 106 have the same polygonal shape as the outer shape of the tiles 104. These indentations 112 are very slight shallow wells to properly position and hold the tiles 104 in their original designated locations individually or in groups on the surface of the shell 1106. The indentations 112 are in the range of approximately 0.050 mm to approximately 3.175 mm deep in the shell 106. The indentations 112 can accommodate the overall shape of the tiles 104 for a uniformed fit. Within each of the indentations 112 are flower shaped wells 114 which are deeper into the shell 106 surface than the indentations 112. Inside the flower shaped wells 114 are holes 116 with channels 118 that are also configured in a flower shape. The holes 116 and channels 118 make up a cut through space through the shell 106 and provide a passage from the inner part of the shell 106 to the outer part of the shell 106 for the tile assemblies and tethering elastic cords which will be discussed below. Flower shaped wells 114 are configured to hold a flat metal magnetic piece 120 also having a flower shape and approximately 0.05 mm in thickness. On the underside of each tile 104 (as shown in FIG. 13) is a similarly shaped magnetic piece 120 to keep the tile 104 centered in its designated position and help return each impacted tile 104 tile to its original position.

FIG. 5 shows a side cross-sectional view of the helmet 100 with the tile layer 102 in place. The tiles 104 are part of a tile assembly 138 which will be discussed in detail in connection with FIG. 13. The tile assemblies 138 and tethering elastic cords 124 are connected from the inside of the shell 106 through the holes 116 and channels 118.

Figure 6:
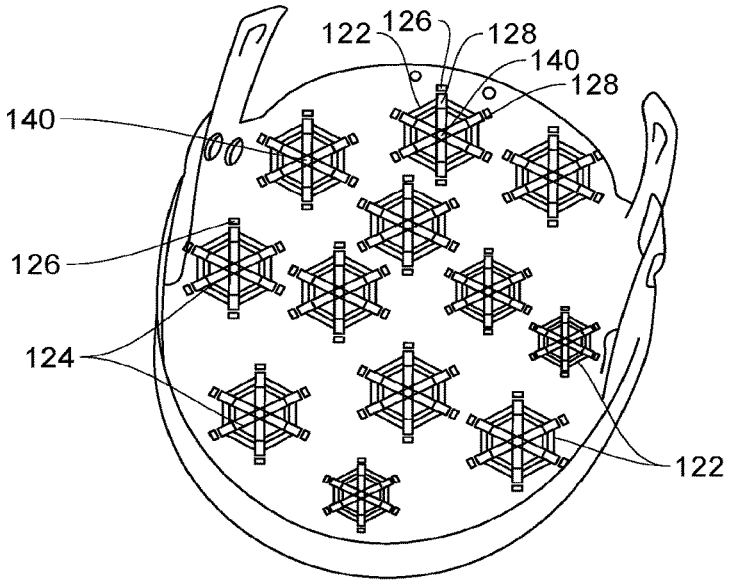
FIG. 6 shows an interior, underside view of the helmet 100 with holes 116, hexagon shaped assemblies 122 (or hexagon assemblies), elastic cords 124, and anchor points 126 shown.

FIG. 6 shows an interior, underside view of the helmet 100 with holes 116, hexagon shaped assemblies 122 (or hexagon assemblies), elastic cords 124, and anchor points 126 shown. Anchor points 126 are at each corner of the hexagon assemblies 122 to hold the elastic cords 124 in place securely. A recessed underneath network of anchoring points 126 keep the tethered tiles 104 in place and function as fixed, sliding or rotational securing locks. As discussed above, this allows tiles 104 to physically move (e.g., slide) in any direction while compressing and expanding and snapping back into their original designated positions. The raised hexagon assemblies 126 have raised anchor point tubes 128 for the elastic cords 124 to be threaded through. Each tile 104 is tethered by elastic cords 124 through holes 116 and anchor point tubes 128 to an underlaying anchor point 126. The anchor points 126 may be adjustable screws.

Figure 7:
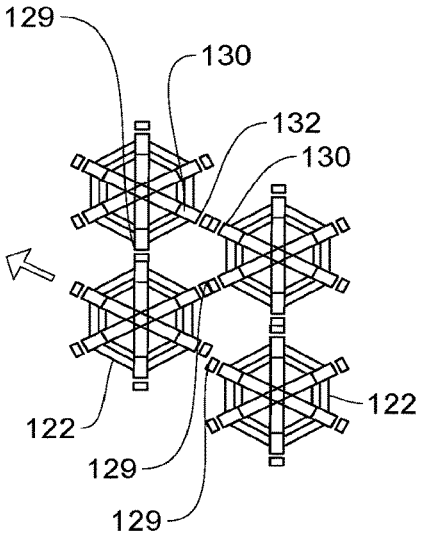
FIG. 7 shows a detailed view of the hexagon assemblies 122.

FIG. 7 shows a detailed view of the hexagon assemblies 122. In addition to the anchor point tubes 128 being connected to an anchor point 126, the hexagon assemblies may be joined through connectors 129. These connectors 129 could be made of elastic cords 124. Alternatively, hexagon assemblies 122 may be joined in another way. The anchor point tubes 128 can have a magnet end 130 which is connected to a magnetic coupling 132. The magnetic coupling 132 will join the hexagonal assemblies 122 together by connecting the magnet ends 130 on the anchor point tubes 128 of two hexagon assemblies 122. In another embodiment, there are magnetic components inside or part of the elastic cords 124. The magnetic tile components can be part of the elastic cords 124 or their respective anchor points 126. Magnetic components can keep the cords 124 taught. Also, magnetic components can act in impact resistance as a resistant force against applied outside impacts. Additionally, magnetic components can act as added retrieval means, while elastic cords 124 are momentarily dispersed, to react to shifting positions brought about by impact and therefore retract to the first position.

Figure 8:
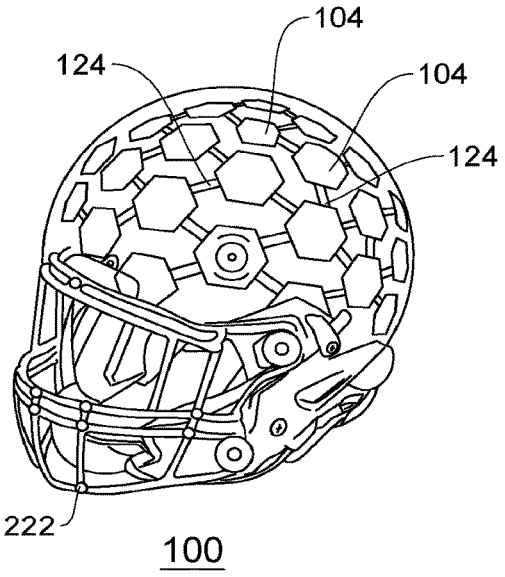
FIG. 8 shows a tethering system of the shell 106.
Figure 9:
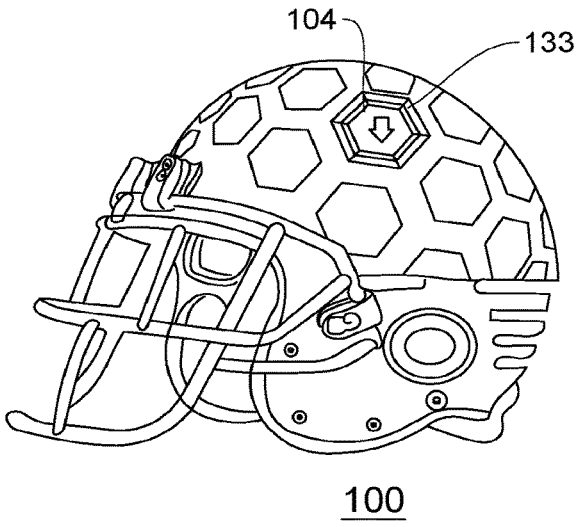
FIG. 9 shows an alternative embodiment of the tile layer 102 in which the shell 106 walls can retract.

FIG. 8 shows a perspective view of helmet 100 with a network of elastic cords 124 connecting tiles 104 to anchor points 126 on the interior of the shell 106. The movement of the tiles 104 is controlled by tethering the tiles 104 to each other and to the shell 106 through the interior anchor points 126 in different patterns using elastic cords 124. The elastic cords 124 are flexible, tensile and elastic and can be bungee cord, string, or a spring. The elastic cords 124 could be pulled or pushed which progressively pulls at other connected elastic cords 124 or at the base of an anchor point 126 (that could have its own connected length of elastic cord 124). The elastic cords 124 have a progressive relay effect of increasing resistance from an initial impact to the helmet 100. The elastic cord 124 is capable of retracting back into position after being stretched. When in position before an impact, the tiles 104 are under resistant tension with the elastic cords 124 as an opposing force. In some embodiments, the moveable tiles 104 are fixed in position on the shell 106 and do not slide (i.e., static). The elastic cords 124 can be segmented with springs or magnetic couplings connecting different lengths of the elastic cords 124. In another embodiment, the elastic cords 124 can have additional magnetic or mechanized cord stops that slow down the cords 124 lengthening or shortening. FIG. 9 shows an alternative embodiment of the tile layer 102 in which the shell 106 walls can retract at a retraction portion 139 of shell 106.

Before impact, the tiles 104 normally are at rest inside the indentations 112. When there is an impact, the configuration of the tiles 104 allows them to slide out of position along the surface of the shell 106 and the elasticity of the elastic cords 124 quickly returns the tiles 104 to the original position. This movement out of a first position to a second position and back to the first original position typically will happen within a fraction of a second. The tiles 104 will ricochet off the initial impact because of rigid slippery smooth surface tile covers 104*a* (shown in detail in FIG. 14A). The tiles 104 are further configured to then take the remaining energy of the impact and extend it over a large area.

Tiles 104 are also capable of moving within the plurality of channels 118 (shown in FIG. 4) located in the shell 106 around holes 116 upon impact. These channels 118 are substantially parallel to the outer contour of the helmet 100. The channels 118 allow a full range of motion in any direction for the tiles 104 to move along those channels 118. As shown in FIG. 13 each tile assembly 138 is made up of a tile 140, stem 142 and presser foot 144. The tile stems 142 are configured to slide in and out of the different channels during an impact event. These channels 118 allow the tiles 104 to move fluidly in a parallel fashion to the helmet's overall shell 106 surface without flipping up unwantedly. The channels 118 can be access points to connect elastic cords 124 to the interior of the shell 106. The elastic cords 124 are tethered to the tile stem 142 on the interior underside of the shell 106 surface, the stem 142 goes through channels 118 and the stem 142 is positioned through the base shell 106. The tile stem 142 goes through the hole 116 of the flower shaped cut through on the shell 106.

Elastic cords 124 allow the tiles 104 to return the moveable tiles 104 back into their designated positions. Elastic cords 124 can also be connected between two tiles 104, other elastic cords 124, tile covers 104*a*, tiles 104 that are fixed, shell 106, and holes 116. In another embodiment, the elastic cords 124 can be connected regionally to sections of tiles 104 or individually to tiles 104. The elastic cords 124 can either be connected to or through the tiles 104 and anchoring points 116 like a network (or "spiderweb") of elastic cord 124 connections. Therefore, when one or more tiles 104 moves, the corresponding network of elastic cords 124 beneath the sublayer of the shell 106 surface moves in congruently in direct correspondence to the tile(s) 104 movement. In some embodiments, the elastic cords 124 can be made up of one or more segments which are joined at a junction point with each cord 124 being tethered to one corner of a tile's 104 respective channel 118 corner on the helmet's sublayer underneath the shell 106 and the other end of one of the elastic cords 124 being tethered to the exterior tile 104 positioned over the cord 124 hole 116.

Figure 10:
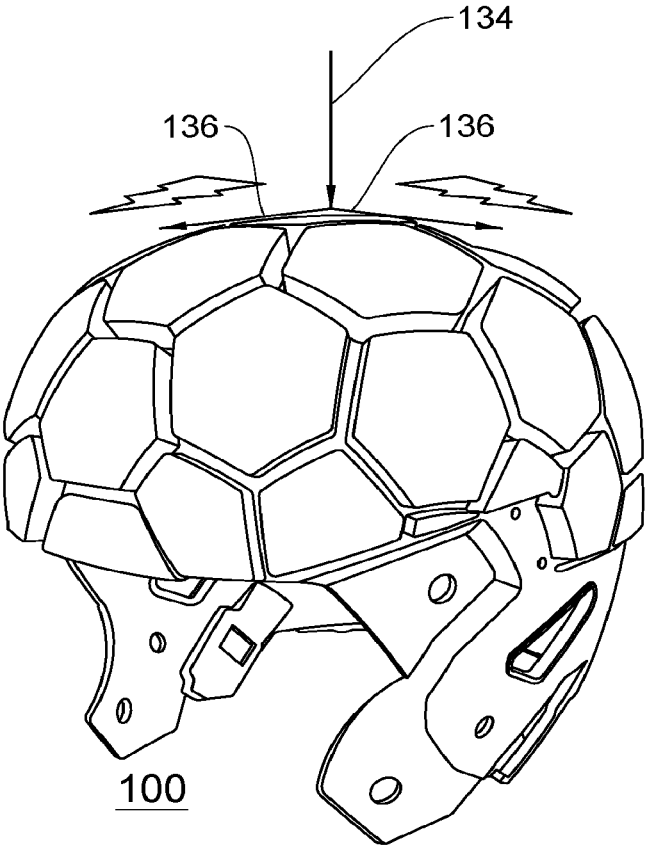
FIGS. 10 and 11 show how the forces of an impact are dispersed in the helmet 100.
Figure 11:
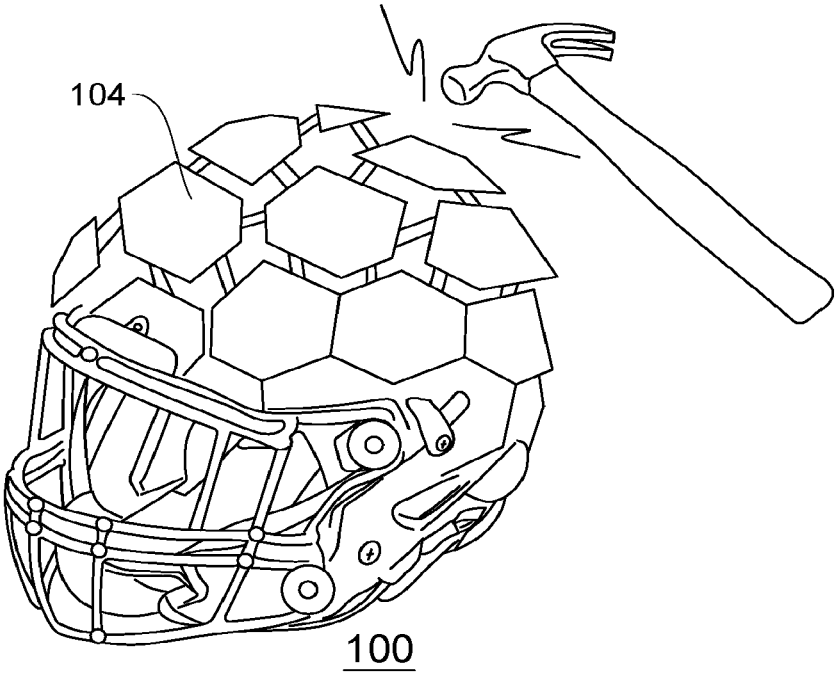

This dispersive system and method disclosed herein provides at least two beneficial functions as demonstrated in FIGS. 10 and 11. Impact is the point of contact when a player's helmet 100 is hit by an opponent or other object (e.g., a hammer). First, the system and method spreads the force of the impact over a large surface area horizontally away from the player's skull and not into it and downward onto the skull which lessens the forced directed into the skull. The impact longitudinal wave 134 is redirected to transverse waves 136 perpendicular to the original hit. Second, the system and method extends the length of the impact. A typical rigid helmet will explode at the point of impact and reverberated energy will go straight down. The embodiments disclosed herein extend the length of the impact by making the tiles 104 slide upon contact as shown in FIG. 11 and therefore absorb the impact energy by redirecting it and extending its path as shown by arrows 136. This in turn slows down the acceleration and therefore strength and ferocity of the impact.

In some embodiments, the tiles 104 may be configured to rotate as well as shift. The tiles 104 may remain fully or partially flexed without compromising their structural integrity so that they do not need to be replaced after each impact. In some embodiments, the tiles 104 are molded partially or fully to form the tile layer 102 over the shell 106. Alternatively, the tiles 104 may be integrated as part of the shell 106 of the helmet 100 instead of (or in addition to) being tied to the shell 106 by the elastic cords 124. In some embodiments, the tiles 104 can be sectioned within a plurality of groups or entirely barricaded from any part of the helmet 100 by a fence barrier. Individual tiles 104 can have different dimensions and/or thicknesses (i.e., depths) to allow them to contour better in the tile layer 102 to the exterior of the shell 106.

Figure 12:
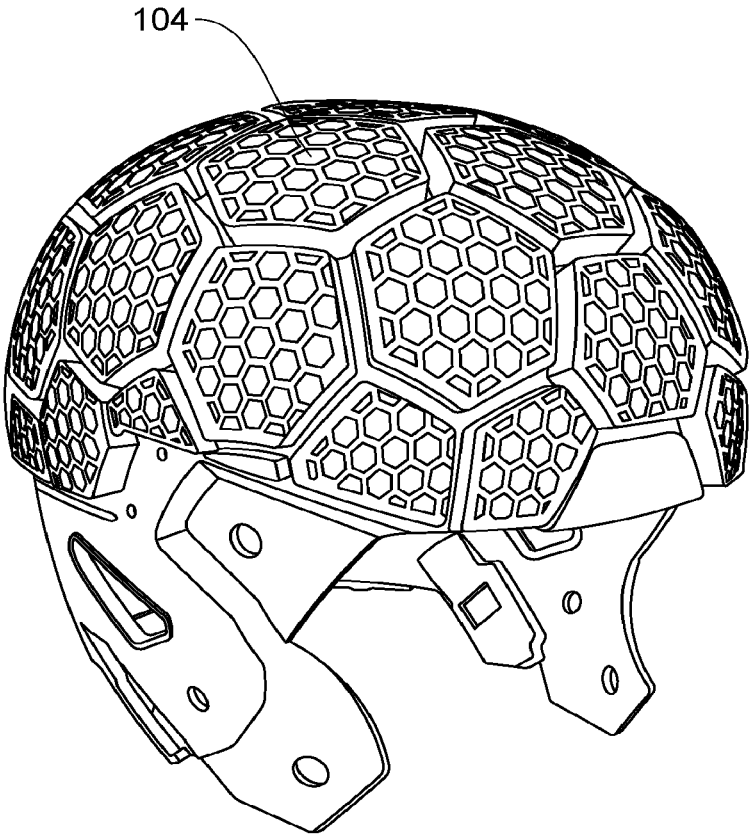
FIG. 12 shows a perspective view of the helmet 100 with the tiles 104 in place on the shell 106 with tile covers 104*a* of the tiles 104 removed.

FIG. 12 shows a perspective view of the helmet 100 with the tiles 104 in place on the shell 106 with tile covers 104*a* of the tiles 104*a* removed. FIG. 13 shows a side view of a tile assembly 138 having a tile 104, stem 140, and presser foot 142. Tile 104 is connected to stem (or shaft) 140 which in turn connects to presser foot (or wingnut) 142. Stem 140 is configured to compress like a shock absorber. A presser foot 142 acts as a "nut", "wingnut" and/or "washer" hardware piece from the interior of the shell 106 on the opposite side of the hole 116 to prevent the tile 104 from lifting off from the hole 116. The presser foot 142 is configured to move with the tile 104. The presser foot 142 is generally large than the hole 116 where elastic cords 124 go through the shell 106. Presser foot 142 prevents the stem 140 from being lifted off and through the shell 106 and the tile 140 off the helmet 100. Presser foot 142 has an elastic cord holding piece 142*a* with which the elastic cord 124 is threaded through. In some embodiments, the presser foot 142 can be fixed or rotate as the tiles 104 move around the holes 116 connected by elastic cords 124. The tile width (TW) as shown in FIG. 13 will be approximately 63.5 mm. The tile height (TH) will range from approximately 4.0 mm to approximately 26 mm. The stem height (SH) will range from approximately 3 mm to approximately 13 mm. The presser foot height (PFH) will range from approximately 0.5 mm to approximately 7 mm. The presser foot width (PFW) will range from approximately 3.9 mm to approximately 45 mm with typically being approximately 22.2 mm.

Figure 14A:
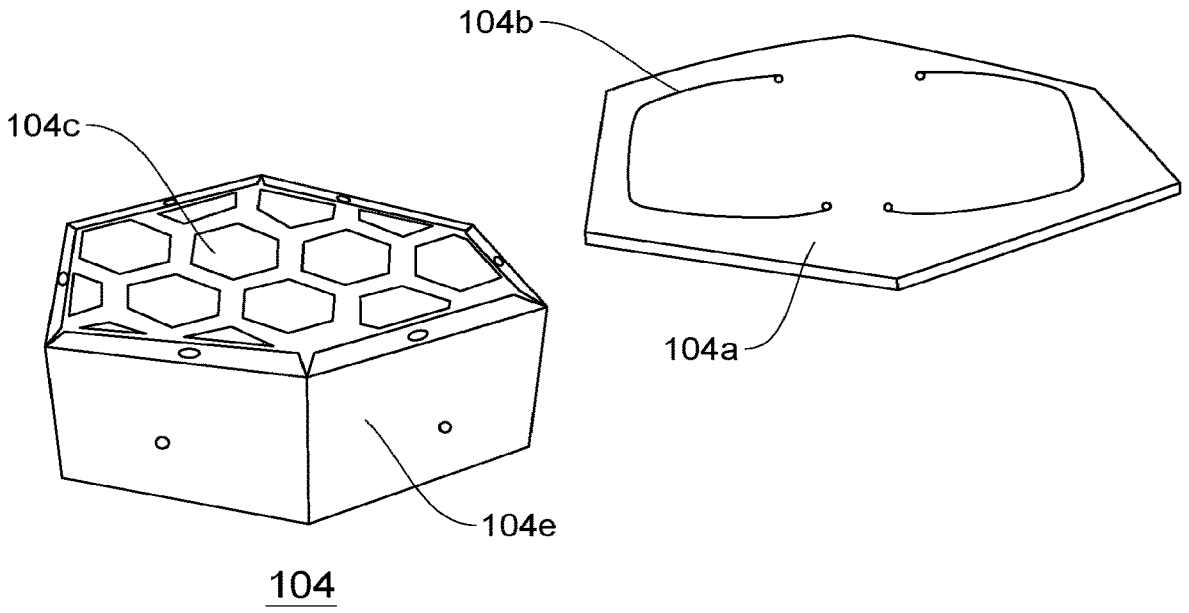
FIG. 14A shows a perspective view of an individual tile 104.
Figure 14B:
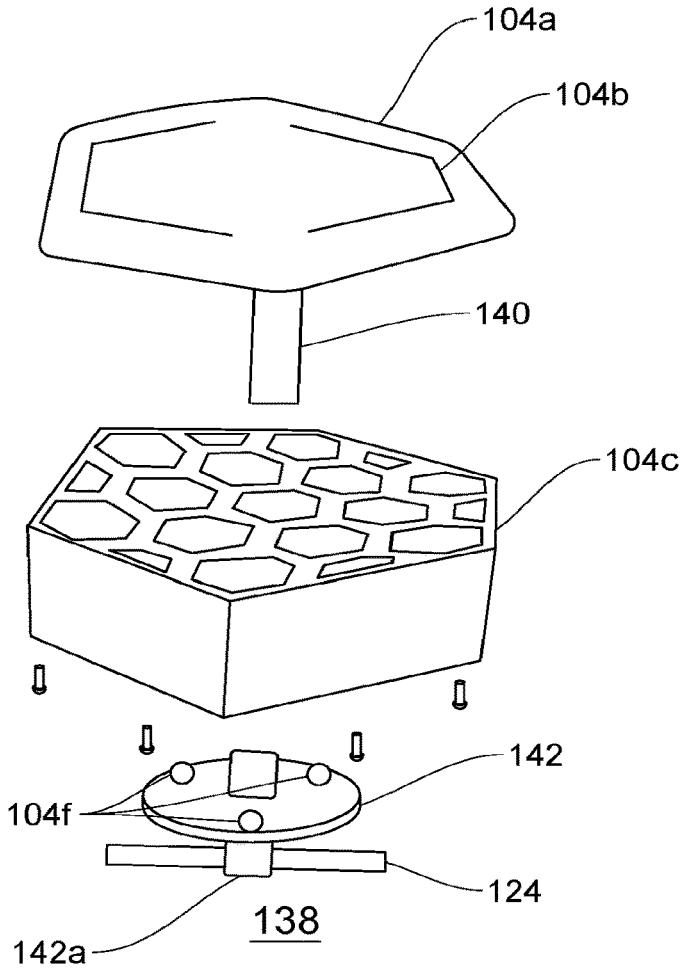
FIG. 14B shows an exploded view of tile assembly 138 and FIG. 14C shows a tile assembly 138 in position on the shell 106.
Figure 14C:
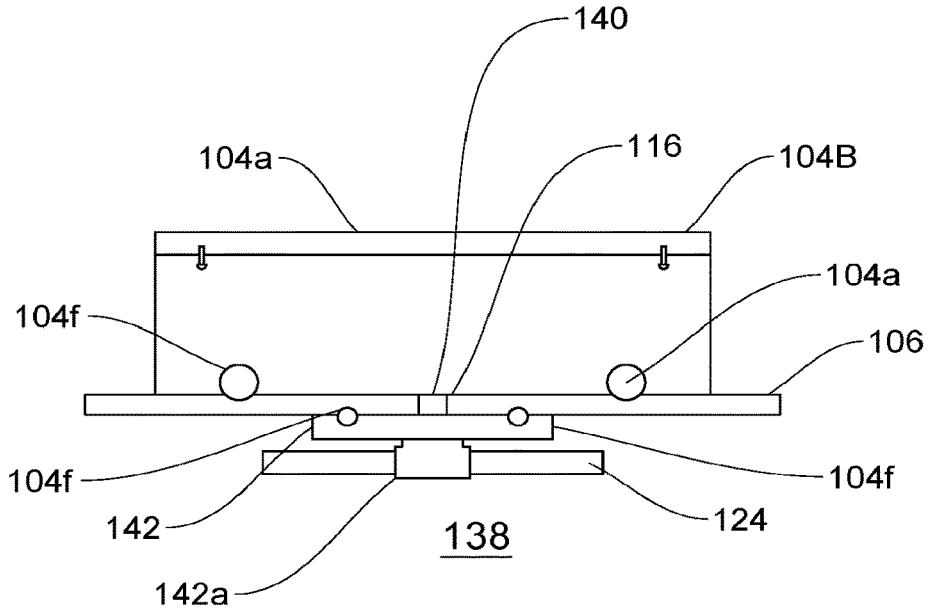
Figure 15:
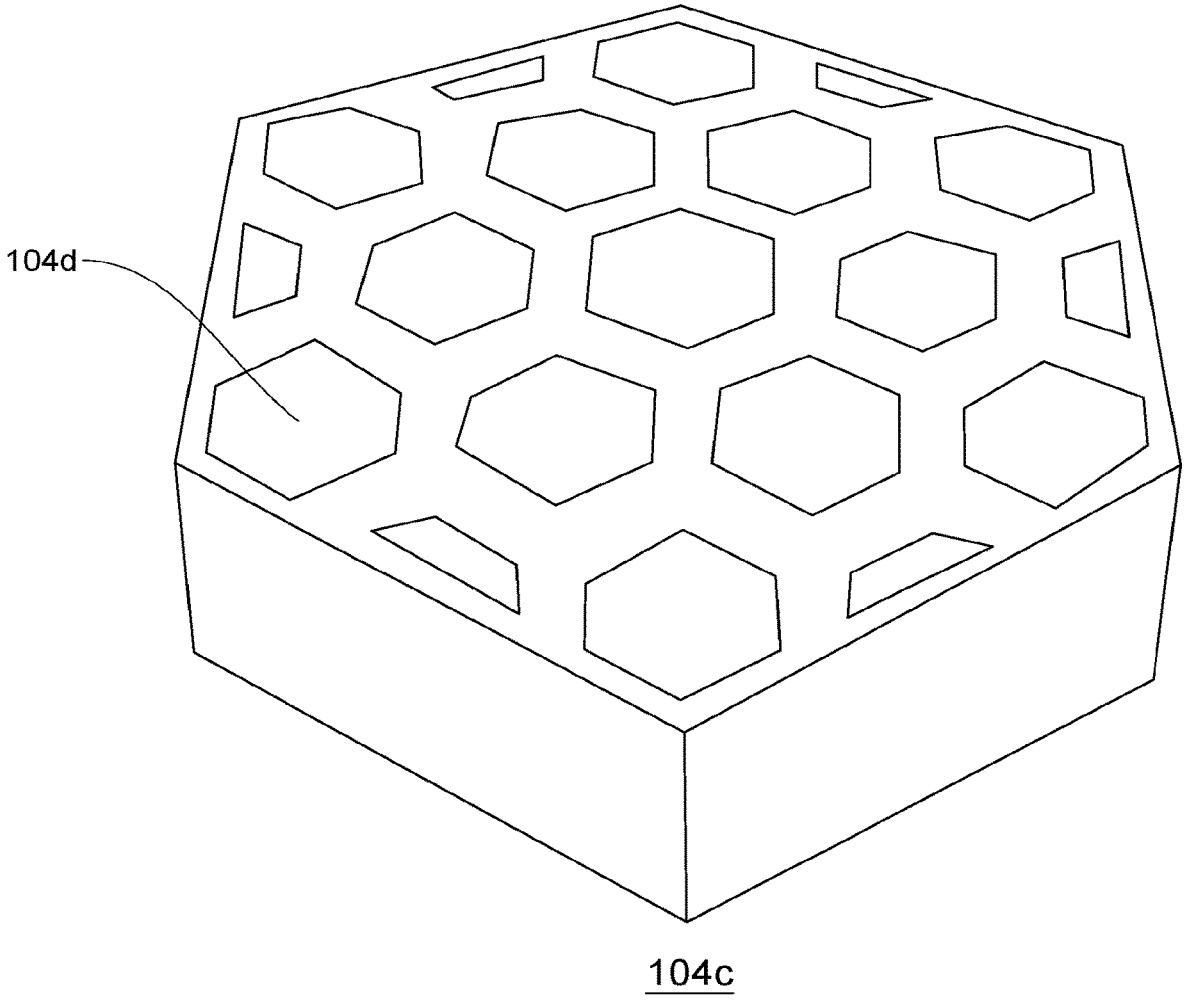
FIG. 15 shows a perspective view of an insert 104*c*.

FIG. 14A shows a perspective view of an individual tile 104. Each individual tile 104 is capable of moving in 360 degrees direction as determined by the velocity, angle, and position of an impact. The stem 140 of the tile 104 goes through hole 116 which allows the stem 140 and therefore the tile 104 to rotate in that hole 116 in 360 degrees like a straw rotating around the inside wall circumference of a glass of milk. The stem 140 can also move in and out of the channels 118. Each tile 104 is configured to slide into an adjacent tile 104 in a domino effect to extend the time of the impact and prolonging the impact across the helmet shell 106 surface. This creates more resistance with each slammed tile 104 while slowing down the acceleration and momentum of the impact. A tile cover 104*a* installed over the tile 104 has multiple hinge indentation cutouts (or hinges) 104*b* that temporarily compress and are capable of being pushed inward and downward. The tile cover 104*a* is polycarbonate and approximately 3.175 mm thick. The tile cover 104*a* is installed over a EVA flexible rubber honeycomb insert 104*c* made up of cells 104*d* like a roof. FIG. 14B shows an exploded view of the tile assembly 138. FIG. 14C shows a tile assembly 138 in position on the shell 106. Tracking balls 104*f* of varying sizes in both the insert 104*c* and presser foot 142 help maintain the attachment to the shell 106. FIG. 15 shows a perspective view of an insert 104*c*. The tile cover 104*a* can have cut through "U" grooves like a trap door and is pushed down into position. The part of the "U" groove that is intact acts as a hinge. The tile cover 104*a* is independently mounted on a sliding tile 104 rather than on the shell 106 of the helmet 100. Hinges 104*b* are cut out to operate as a lever to allow the tile hard cover flap sections to move and the ability to be compressed downward upon impact and then retract back up because of the nature of the flexible tile hard shell cover material. The hinges 104*b* spring back to their original shape and position. A cut through groove that acts as one or more downward depressing flexing flaps specifically for the tile covers 104*a*. The hinges 104*b* are configured to have an offsetting effect on impacts from any direction. The hinges 104*b* are configured specifically for moveable tiles 104 as well as their tile covers 104*a* as an added feature of dispersing energy, force, and impact. It is because of the nature of the moveable tiles 104 and their ability to slide and return that adding a very specific downward flexing hinge(s) 104*b* action adds to the extension of time and a diminishing of force combined with the progressive and sequential motion of the tiles 104 upon impact to behave in a complementary way. The hinges 104*b* may also be integrated with the tile 104 so that the tile covers 104*a* can slide past the honeycomb tile insert 104*c* and not necessarily move with them. This feature provides an added element of impact force lengthening and deacceleration. The interior shock absorbing cells 104*d* of insert 104*c* make up the interior of the tiles 104 and act as impact absorbers. The inserts 104*c* are a combination of air cells 104*d* and a honeycomb of walls capable of temporarily collapsing and springing back into position. The inserts 104*c* are an interlocking polycarbonate (e.g., same polycarbonate as the shell 106, rigid and flexible material such as EVA, Kevlar or a Kevlar synthetic blend). The inserts 104*c* are positioned over the tile indentations 112 of shell 106. The interior shock absorbing cells 104*c* can be flexible or rigid. The inserts 104*c* can be molded as an integral piece or can be integrated with an outer tile covering 104*e*. The tile cover 104*a*, hinge 104*b*, interior shock absorbing insert 104*c*, and the outer tile covering 104*e* are part of the raised profile tile layer 102 of the helmet 100. The bottom of the tile 104 can left open or partially accessible for the elastic cord 124 to be connected therethrough.

Figure 16:
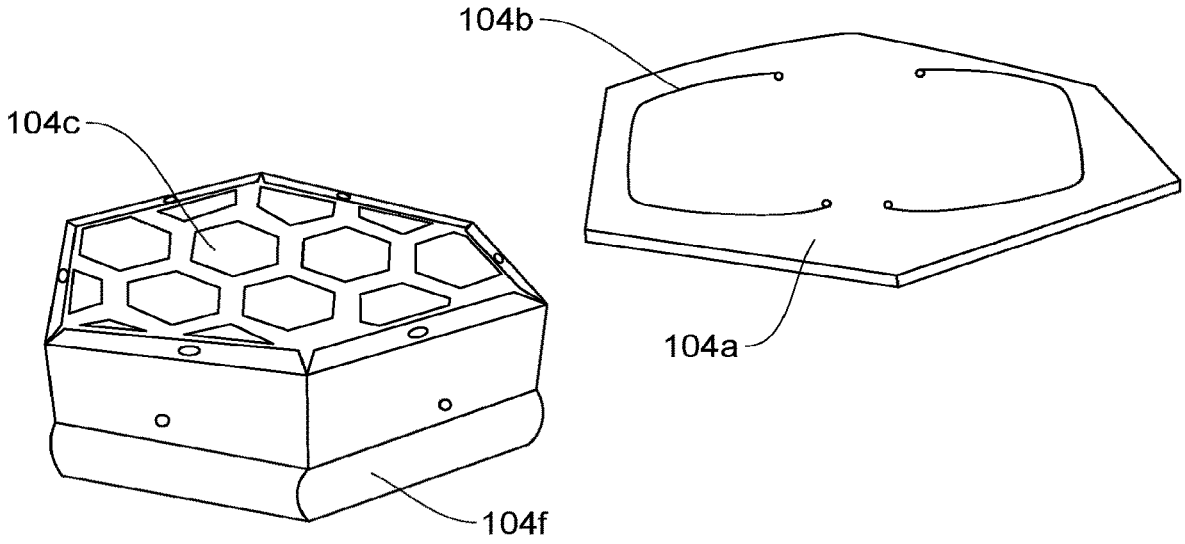
FIGS. 16 and 17 show an alternative embodiment wherein the tile 104 may have a raised surface bumper spring 104*e* in order to provide an added layer of cushion or buffer.
Figure 17:
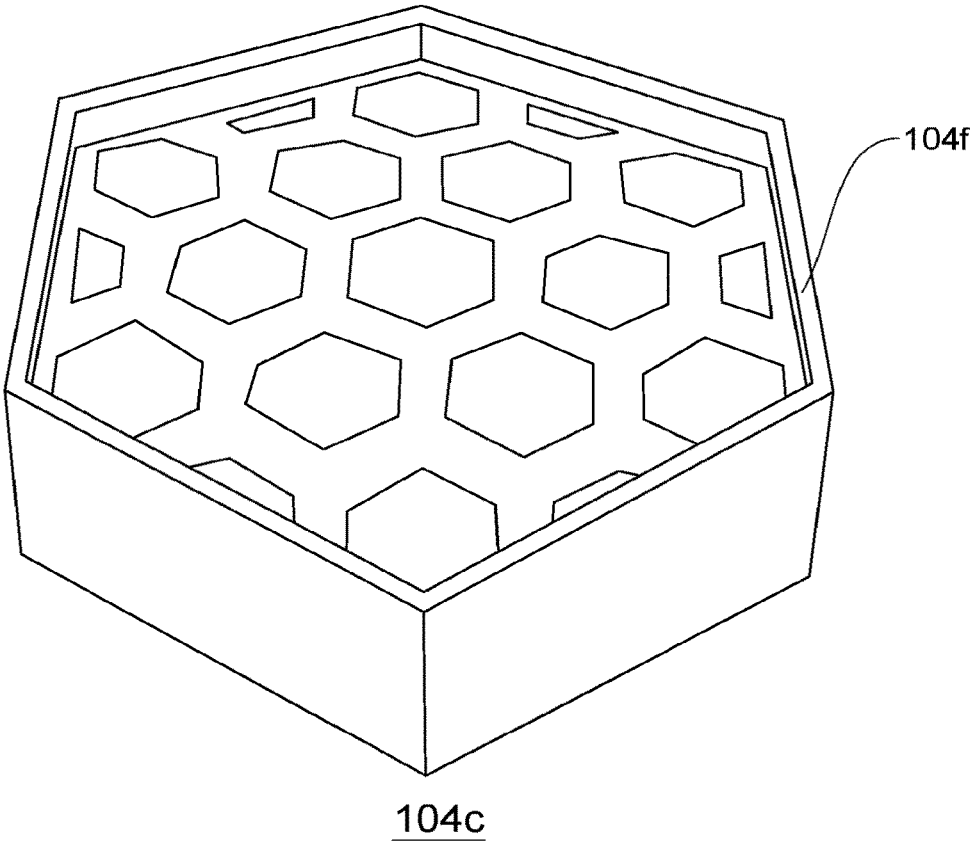

FIGS. 16 and 17 show an alternative embodiment wherein the tile 104 may have a raised surface bumper spring 104*e* in order to provide an added layer of cushion or buffer. This bumper spring 104*g* can be built as a separate mechanism, an entire single unit or an integrated component.

Figure 18:
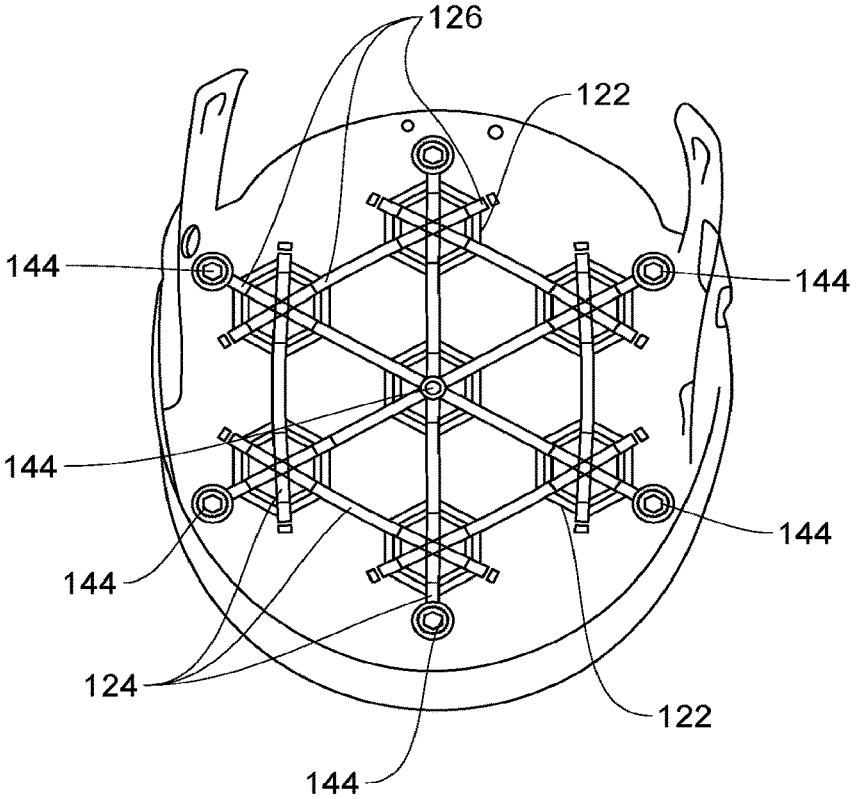
FIG. 18 shows an alternative embodiment of the helmet 100 with the underside, interior of the helmet 100 having ratchet wheels 144 replacing some of the anchor points 126 to allow for adjustment of the tension on the elastic cords 124.
Figure 19:
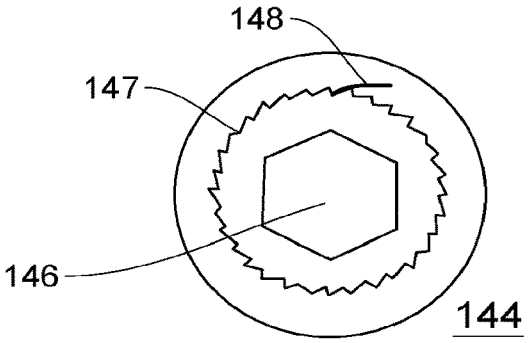
FIG. 19 shows a ratchet wheel 144 with a hexagonal screwdriver bit opening 146 to adjust and tighten the tensile taughtness of the elastic cords 124.
Figure 20:
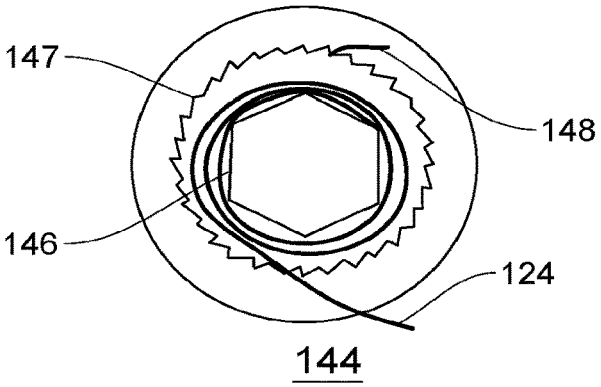
FIG. 20 shows how the ratchet wheels 144 spool the elastic cords 124 in a circle making the elastic cords 124 tighter with every turn of the screw.

Returning to FIG. 6, the anchor points 126 may be adjustable screws in the form of ratchet wheels. FIG. 18 shows the underside, interior of the helmet 100 with ratchet wheels 144 replacing some of the anchor points 126 to allow for adjustment of the tension on the elastic cords 124. FIG. 19 shows a ratchet wheel 144 with a hexagonal screwdriver bit opening 146 in the ratchet 147 to adjust and tighten the tensile taughtness of the elastic cords 124 and a pawl 148 to prevent the ratchet 147 from recoiling. FIG. 20 shows how the ratchet wheels 144 spool the elastic cords 124 in a circle making the elastic cords 124 tighter with every turn of the screw.

Figure 21:
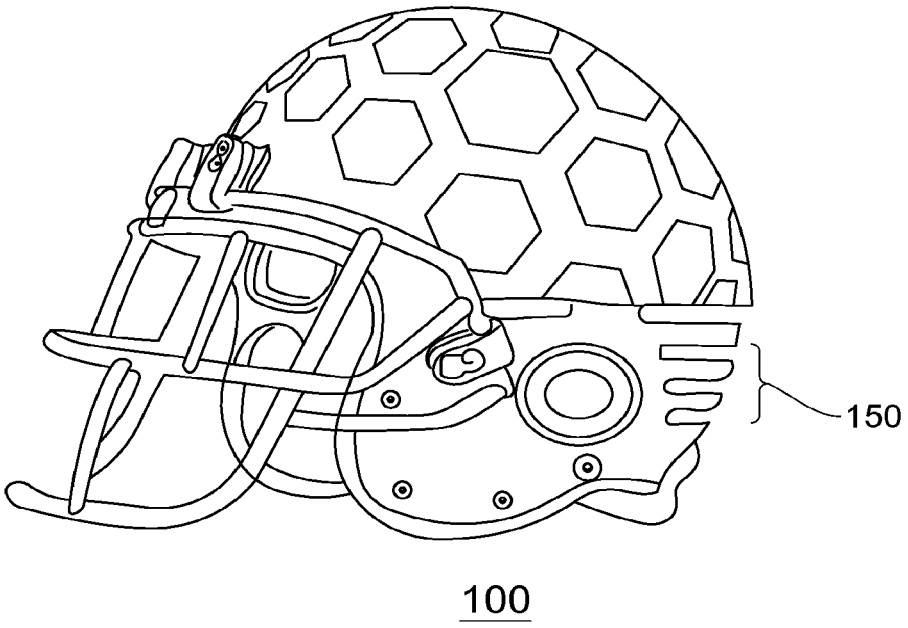
FIGS. 21 and 22 shows compression neck grooves 150 located in the rear of the helmet 100 in the area where the user neck would be located.
Figure 22:
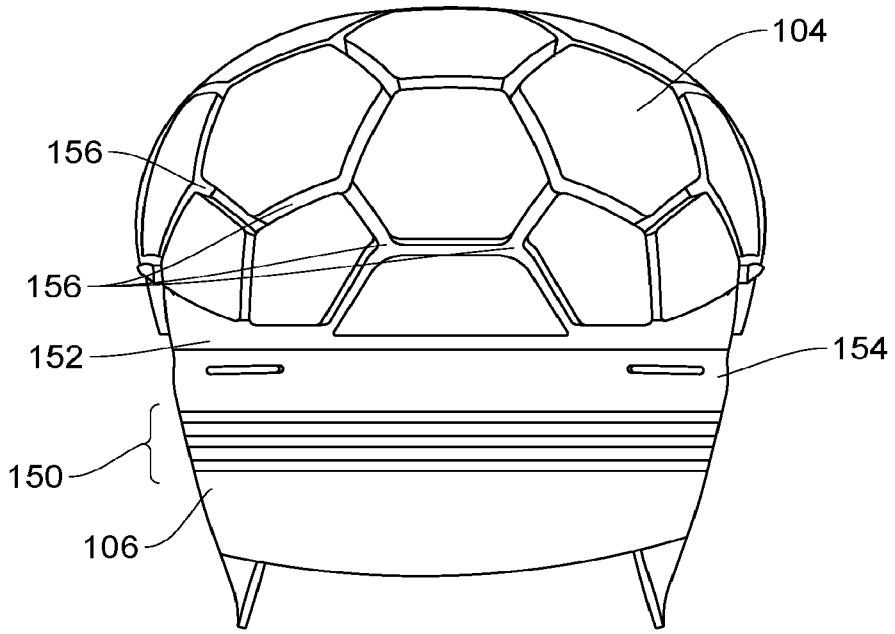
Figure 23A:
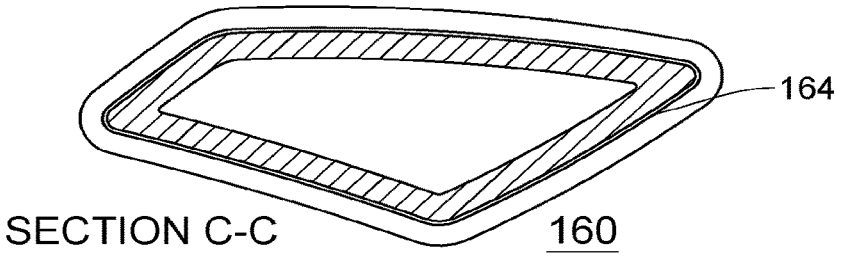
FIGS. 23A-23D illustrates an ear hole cover bumper 160.
Figure 23B:
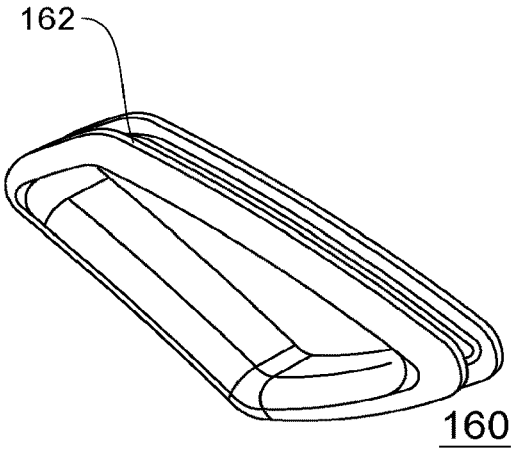
Figure 23C:
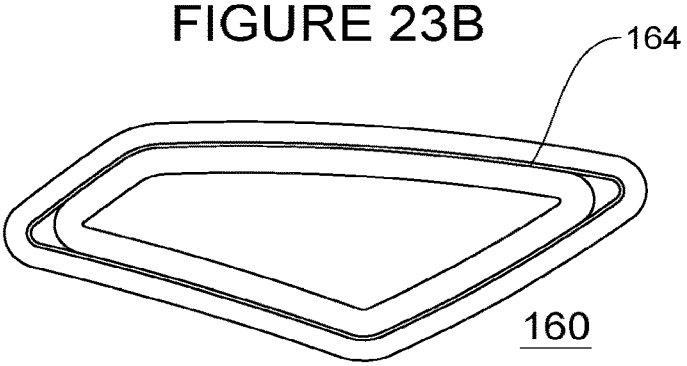
Figure 23D:
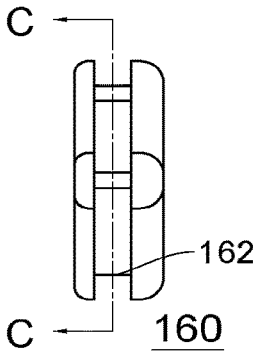

FIGS. 21 and 22 shows compression neck grooves 150 located in the rear of the helmet 100 in the area where the user neck would be located. The compression neck grooves 150 extend into the shell 106 and around the back of the helmet 100. The compression neck grooves 150 can be one or more in quantity (e.g., 3 or 4). The compression neck grooves 150 are collapsible upon impact and then immediately retract back into the original shape and position. Each of the grooves 150 can move in a range of approximately 1 mm to approximately 2 mm during an impact event. The compression neck grooves 122 add another dimension of flexibility, compression, and retraction to repel an impact from contact from the top region or downward on any part of the helmet 100. These grooves 150 assist in extending the impact forces in different directions to supplement the systems and methods described above.

FIGS. 21 and 22 further shows a fence 152 and a collar 154. The fence 152 is a line of demarcation between the moveable tiles 104 and the collar 154. The fence 152 wraps partially and/or fully around and underneath the moveable tiles 104. The fence 152 assists to slow down and/or stop the movement of the tiles 104 by acting as a barrier. The tiles 104 would move more freely without a fence 152 upon impact when sliding. The fence 152 is a raised profile ridge barrier even though small, but still acts as a "speed bump" to slow down the tiles 104. The fence 152 can be an etching or a raised surface.

FIG. 22 further shows ventilation cut throughs 156 which go through shell 106 in the tile separation spaces 108 to provide air to the interior of the helmet.

Referring back to FIG. 2 there is illustrate ear hole 158 of the helmet 100. The ear hole 158 is constructed in a tri lateral radius corner arc system having a plurality of corner arcs (e.g., three corner arcs). This corner arc system enables each corner arc to be rounded to and accomplish the following functions. First, the ear hole 158 is more durable and stronger than sharper cornered or right angled ear hole constructions because of its fluid and continuous line trajectory, path, and flow. Second, the ear hole 158 is better optimally configured for offsetting and minimizing sound reverberations because of the cylindrical construction. Therefore, the ear hole 158 is more closely fashioned and engineered like the human ear that also has no sharp corners and angles and is similar to the human ear canal in order to achieve optimal hearing for the user.

FIGS. 23A-23D shows an ear hole cover bumper 160 which is an attachment that covers the ear hole 158. The ear hole cover bumper 160 is made from a dense, flexible, and rubber-like material that is installed over and around the outline perimeter of the ear hole(s) 158 on each side of the helmet 100. The cover bumper 160 is an extra layer of protection as it raises the profile of the side of the helmet 100 and is the first point of contact in any contact and is able to act like a bumper as an added layer of protection from impact to the ear hole 158 area. In addition, the ear hole cover bumper 160 protects and buffers the edge and outline of the ear hole 158 to protect it from wear and tear while keeping its structure intact and securely framed. Second, it is an added layer of protection for the ear hole 158 and the player's ear hole safety from impact to the ear hole area. The ear hole cover bumper 160 is removeable for cleaning, maintenance, repair, and replacement. In an alternative embodiment, the ear hole cover bumper 160 can have trenches or grooves to better cushion and provide further shock absorption. The ear hole cover bumper 160 can be configured to be molded into the construction of the helmet 100. The ear hole cover bumpers 160 frame and border the perimeter of helmet ear hole (inside and outside) as an added shock absorber profile and especially helpful for rotational hits.

The ear hole cover bumper 160 can be configured to have a wireless communication device that can communicate with a remote receiver. The ear hole cover bumpers 160 can function like ear buds, air pods, and/or any phone to listen to music and communicate with other wireless receivers.

The ear hole cover bumper 160 can have a four sided, trapezoidal shape as shown in FIGS. 23A-23D (or alternatively can have a round shape). The ear hole cover bumper 160 can pop in securely into the ear hole 158. The ear hole cover bumpers 160 can have recessed gaps 162 in order to create more flexibility to the ear hole bumper 160, create more security, and cushioning as staggered while naturally containing, housing, and/or encompassing added layers of air cushioning. The ridge space 164 assists in fitting the ear hole cover bumper 160 into position in the ear hole 158. The ear hole cover bumper 160 acts as a sanitation barrier and benefits when opposing players hit the side of the helmet. The ear hole cover bumper 160 can be constructed with sanitizing fluid, or be dimpled, and have a porous surface so opposing players cannot have full contact and therefore contaminate the side of the helmet or ear hole bumper. The ear hole cover bumper 160 can be coated, manufactured, and/or treated with a special agent that disallows virus, germs, and contaminants from adhering or attaching to the ear hole bumper or any part of the helmet 100. The ear hole cover bumper 160 can be detachable so it can be separately washed, sanitized and cleansed against viruses like COVID-19, germs, bacteria, and/or any pathogens.

In another embodiment, magnetic components, magnetic fields and magnetic components can keep the tile(s) 104 act in position in formation with other tiles 104 in their respective designated groups. The magnetic tile components can be inserted and/or engineered into the structure of the tile 104 (e.g., within the walls of the tile 104). These magnets in the tile 104 help retract the tiles 104 to their original positions. Also, magnetic components can also act in impact resistance as a resistant force against impacts. Additionally, magnetic components can act as added retrieval means, while tiles 104 are momentarily dispersed, to react to shifting positions brought about by impact and therefore retract and return dispersed tiles 104 or any helmet 100 components back to the original position.

Face Mask

Figure 24:
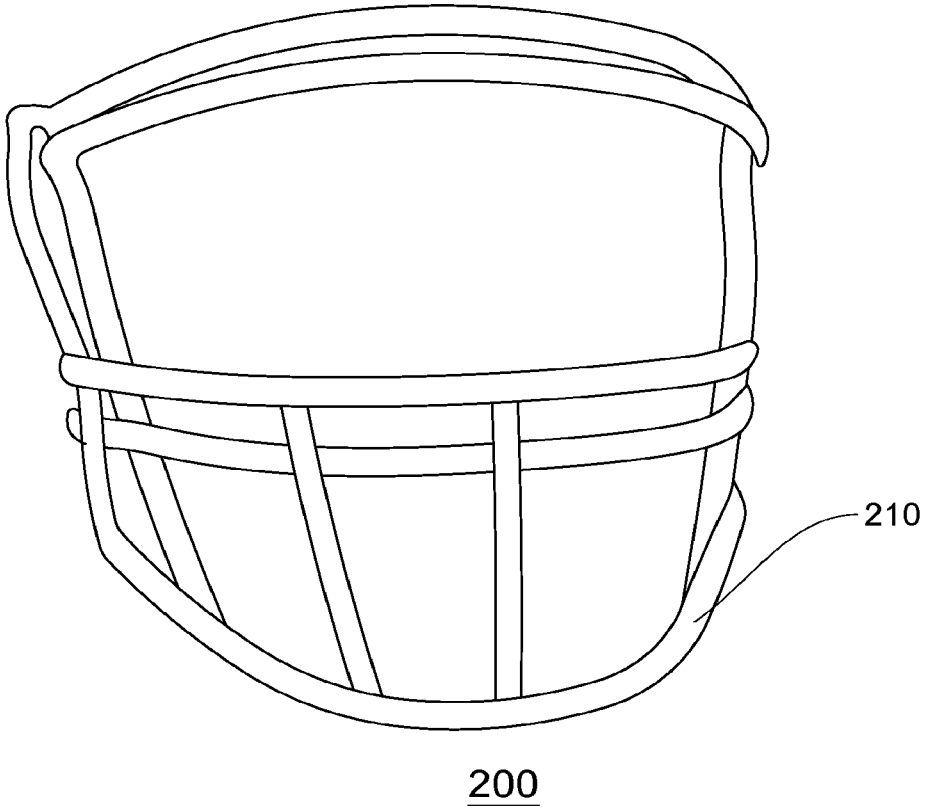
FIG. 24 shows a face mask 200 in an assembled view and FIG. 25 shows the face mask 200 in an exploded view.
Figure 25:
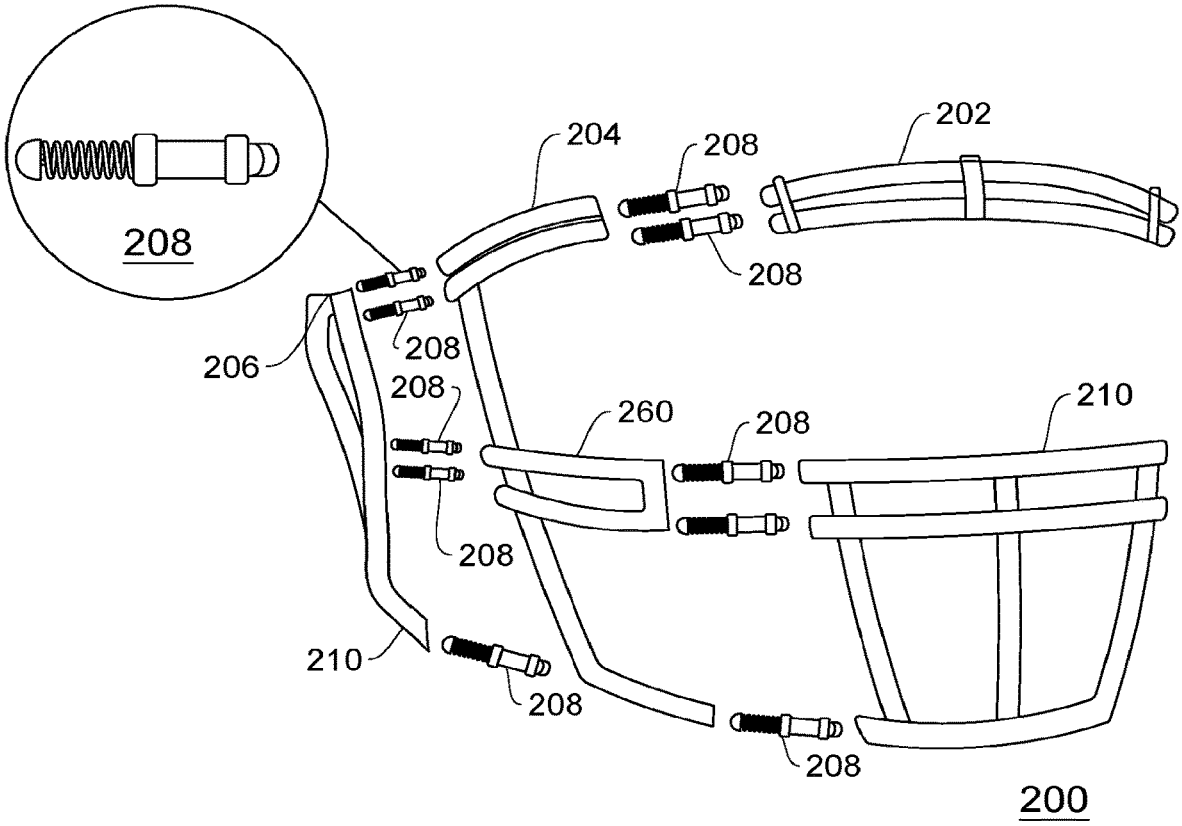

FIG. 24 shows a face mask 200 in an assembled view and FIG. 25 shows the face mask 200 in an exploded view. The face mask 200 is made up of a single front section 202, two middle sections 204 on either side of the front section (only one middle section is shown in FIG. 25), and two back sections on either side of the middle section (only one back section is shown in FIG. 25). Shock springs 208 allow the face mask to be progressively collapsed through the front section, middle section and back section. The shock springs 208 are interposed between the sections 202, 204 and 206 inside a grill of interlocking compression protection bars 210.

Figure 26:
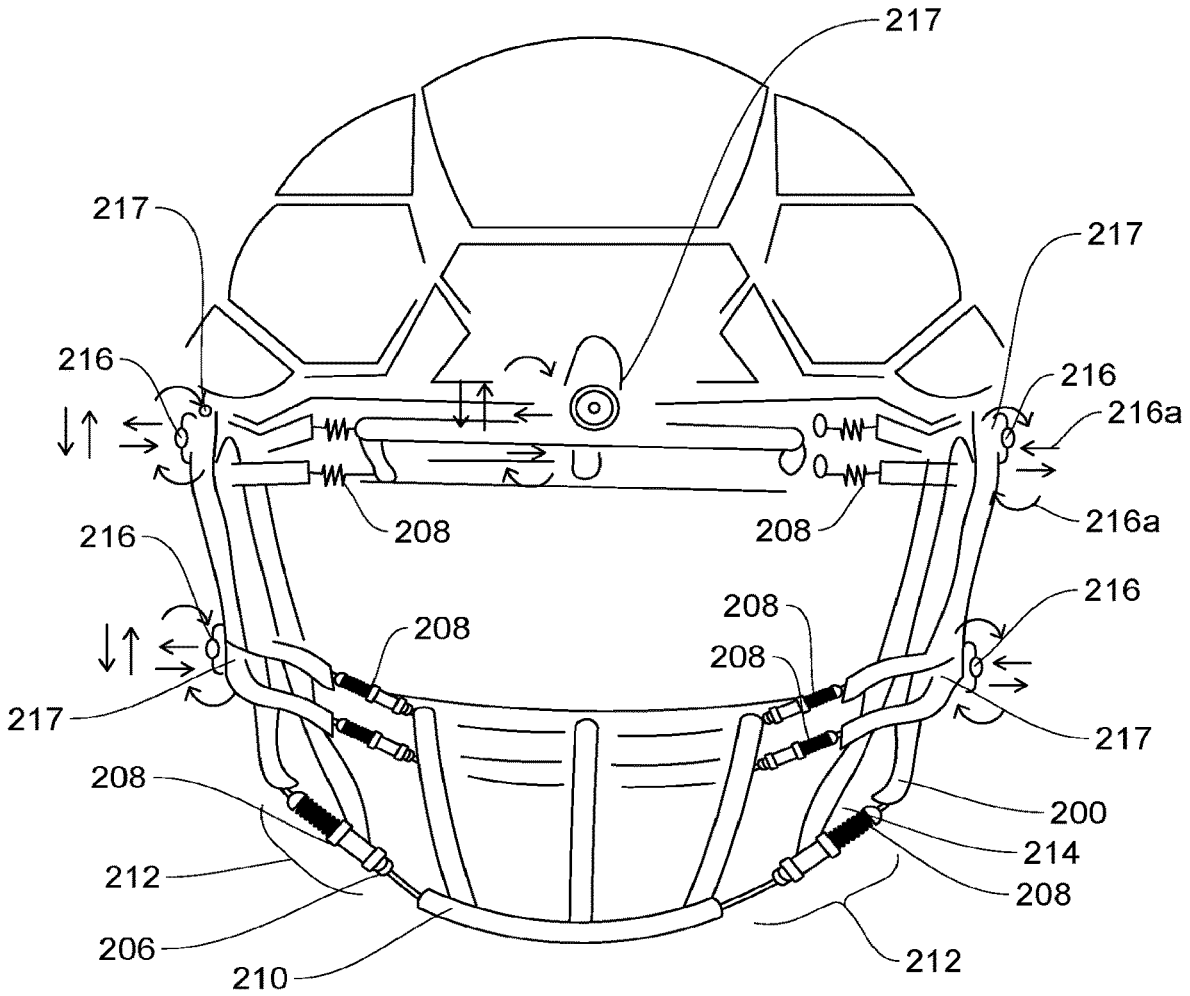
FIG. 26 shows the helmet 100 with a face mask 200 in place.

FIG. 26 shows the helmet 100 with a face mask 200 in place. Reference item 212 shows cutaway sections of the protection bars 202. Inside the protection bars 210 is an interior assembly 214 forming a shock absorbing system made up of the compressing shock springs 208. These shock springs 208 allow the protection bars 202 to move laterally, vertically and in an angular manner. The segmented construction of the face mask 200 where the compressed interior assembly 214 joins some or all of the shock springs 206, but also allows the protection bars 210 to retract and expand again to their original state. This allows the face mask 200 and the compression protection bars 210 to be impacted and retract back to their original positions. Each protection bar 210 is configured to collapse into itself in either a vertical, horizontal or angular manner. The interior assembly 214 can be set to a predetermined pounds per square inch (psi) tolerance. The compression protection bars 210 are joined to the helmet 100 by corner attachment points 216 wherever the face mask 200 is attached to the helmet 100. The corner attachment points 216 can be ball hinges that are screwed into anchoring screws of the corners of the helmet which allows for a full range of swivel motion of the face mask 200. The range of swivel motion is shown by arrows 216*a* and can be vertical, horizontal and angular and may be in the range of approximately 1 mm to approximately 3 mm. The corner attachment points 216 have a base that is affixed to mask anchoring points 217 where the face mask 200 will be attached. The top half of the corner attachment point (e.g., swivel ball hinge) 216 is capable of rotating in any direction which makes the entire face mask 200 capable of moving 360 degrees of direction. The corner attachment points 216 are also shock absorbent and can flex and act as a protruding flexible bumper.

Figure 27:
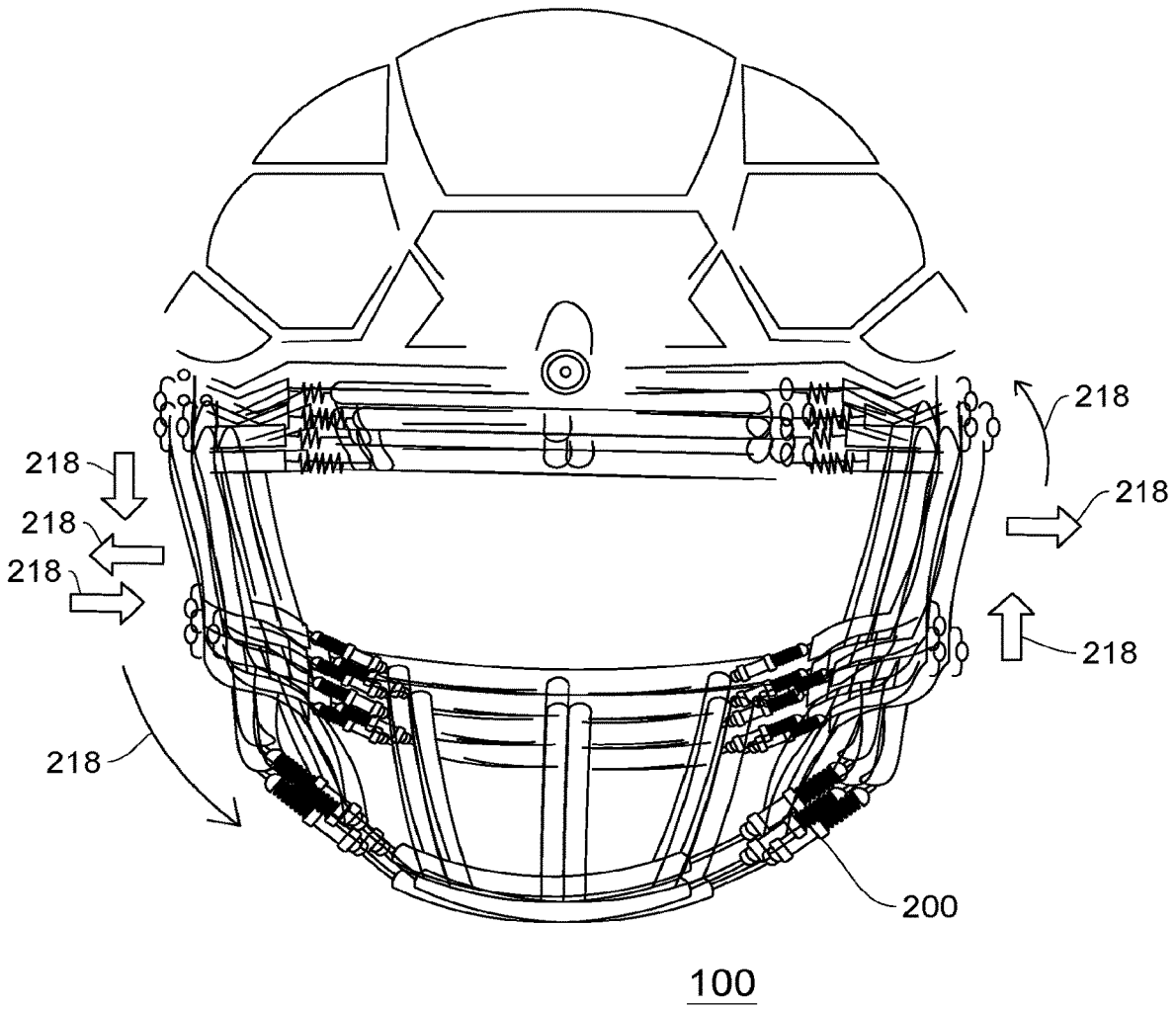
FIG. 27 shows the face mask 200 is capable of moving in multiple directions after an impact as indicated by the arrows 218

FIG. 27 shows the face mask 200 is capable of moving in multiple directions after an impact as indicated by the arrows 218.

Figure 28A:
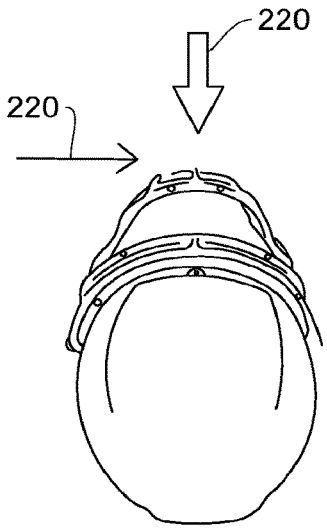
FIGS. 28A-28C show the face mask 200 and its compression protection bars 210 in a progressive collapsible three stage progression.
Figure 28B:
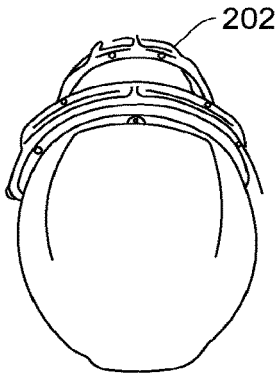
Figure 28C:
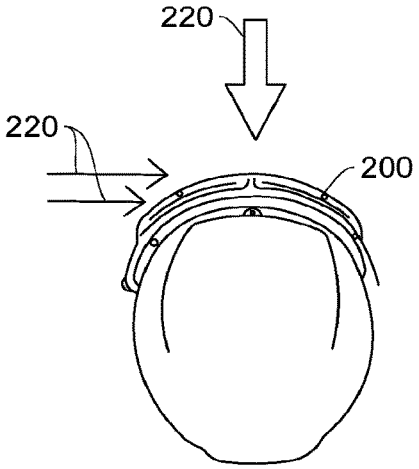

FIGS. 28A-28C show the face mask 200 and its compression protection bars 210 in a progressive collapsible three stage progression. The compression protection bars 210 and compressed interior assembly 214 are predetermined to be compressed and collapse at predetermined positions. The predetermined positions could be based on position, location, pressure, psi, resistance, torque, retractable ratio, depth, or stages of progressive compression into the face mask 200 and/or the helmet wearer. The compressed interior assembly 214 can be set so that the stages of collapse can be set to increasingly more resistant. In another embodiment, the compression protection bars 210 are progressively resistant and are able to collapse in sections. FIG. 28A shows a force 220 from the front or the side impacting the face mask 200. FIG. 28B shows the front section 202 of the face mask 200 can compress to a deliberate range into the middle sections and/or the back sections behind it with increasing resistant psi compressed force. FIG. 28C shows the face mask 200 completely collapsed before springing back into the original position shown in FIG. 28A. Therefore, pneumatic compression seams at all of the connecting joints of the front, middle and back sections allow for the progressive collapse.

Figure 29:
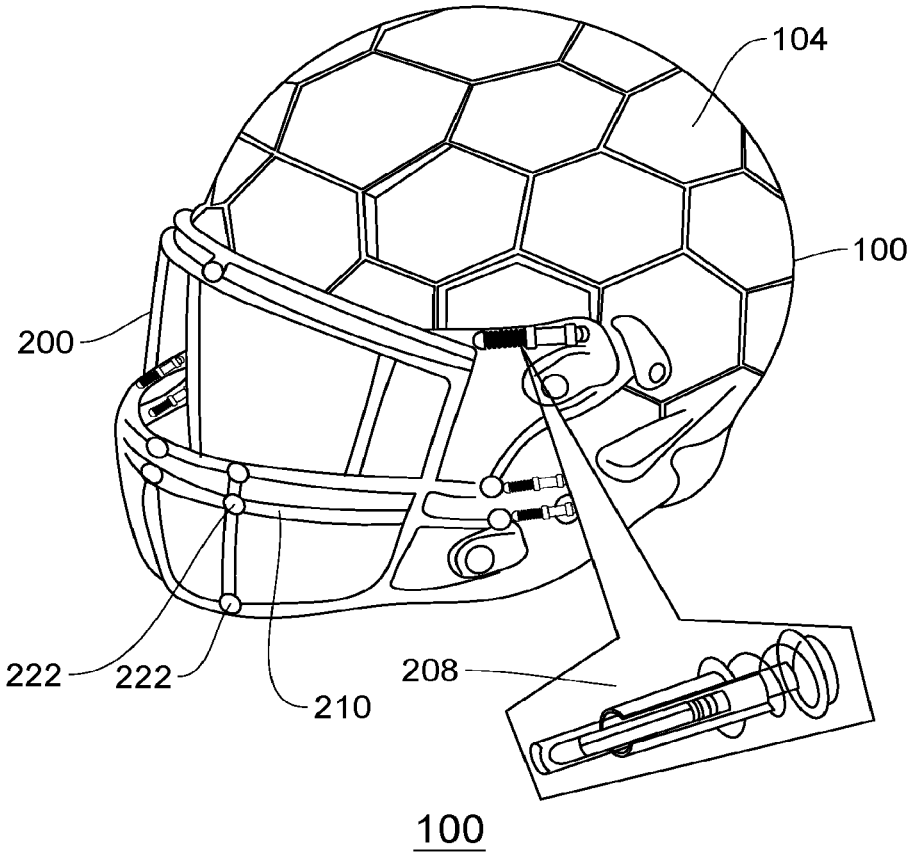
FIG. 29 shows attachable flexible bumper pegs 222 which can be placed anywhere on a face mask 200 to add an extra layer of cushioning.

FIG. 29 shows attachable flexible bumper pegs 222 can be placed anywhere on a face mask 200 to add an extra layer of cushioning. The bumper pegs 222 can be made from strong flexible shock absorbent material including but not limited to: rubber, EVA, acrylic, polyurethane, PVC, polyurethane, and vinyl. The bumper pegs 222 can be fit over sections of the face mask compression protection bars 210 in order to protrude further out and be the first contact point of an impact. The bumper pegs 222 can be built or molded into a part of the face mask 200 or be made of the same material as the face mask 200. The bumper pegs 222 can be retractable and filled with a shock absorbent impact resistant fluid. These attachable bumper pegs 222 are configured to clip onto to any part of the of the compression protection bars 210 to add another layer of cushion, safety and protection against any type of impact and/or force on the protection bars 210. The attachable bumper pegs 222 can be where the protection bars 210 intersect. The bumper pegs 222 are configured to have a space in the back to be affixable to the protection bars 210 with the front side a protruding, roundish bumper.

Helmet Padding System

Figure 30:
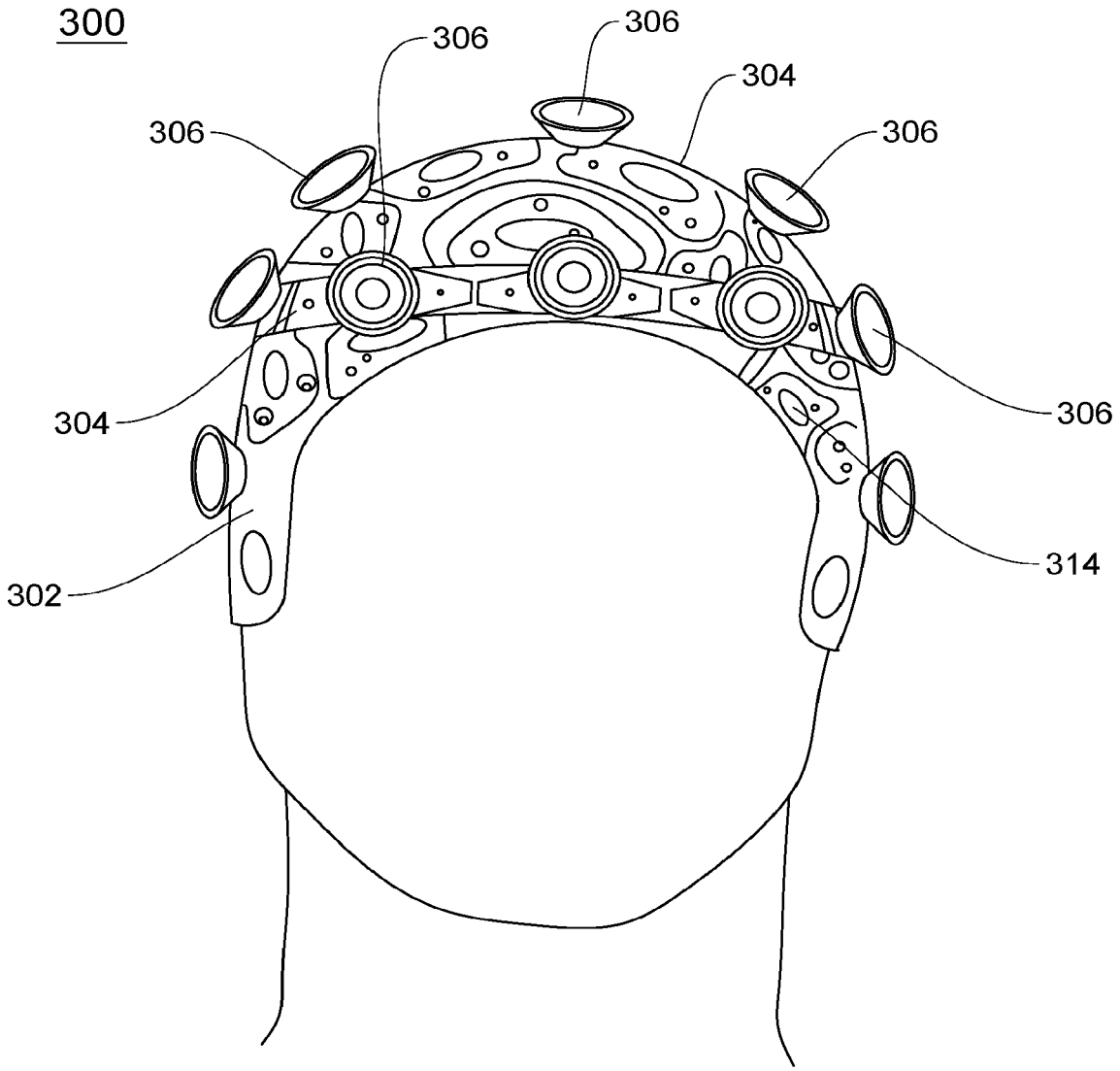
FIGS. 30 and 31 show a dual-layer retractable padding system 300 for helmet 100 to provide padding retractability, movement and compression.
Figure 31:
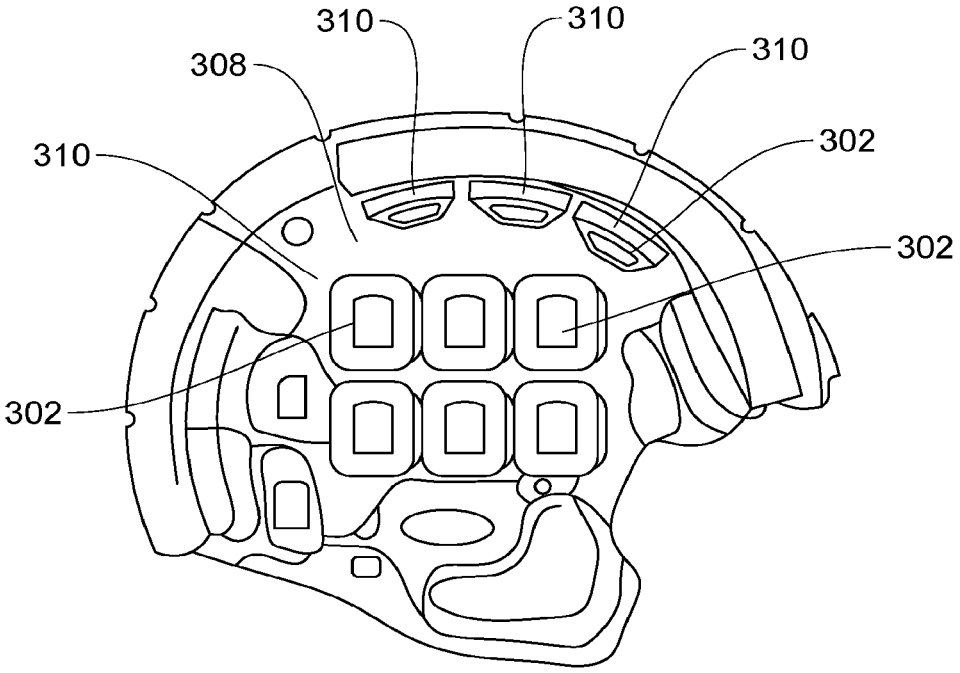

FIGS. 30 and 31 show a dual-layer retractable padding system 300 for helmet 100 to provide padding retractability, movement and compression. Padding system 300 has a first padding layer 302 shown in FIG. 30 which comes in contact with the user's head. The first padding layer 302 can be a customized cap made of a stretchy, breathable, and comfortable material that hugs the head. The first padding layer 302 is configured to hold compression and sensor components. The first padding layer 302 will have head stabilizer components 304 which may in the form of bands. A plurality of flexible compression components 306 are located on the exterior of the head stabilizer components 304. The flexible compression components 306 can be complementary positions to mirror the helmet's 100 interior padding segments discussed below.

As shown in FIG. 31, the system 300 further has a second inner wall padding layer (or second padding layer) 308 made up of flexible mechanisms 310 which is padding just below the hard shell 106 of the helmet 100. The flexible mechanisms 310 line the interior of the shell 106. The flexible mechanisms 310 have cavities that form a first padding layer 302. The first layer 302 and second layer 308 are separated by the flexible compression components 306 and act independently of one another. The flexible compression components 306 attach to and connect inside cavities in the first padding layer 302. The flexible compression components 306 are placed in between the first direct padding layer 302, along with the head stabilizer 304, and second layer 308. The flexible compression components 306, act as a flexible, compression, and retractable barrier between both the first padding layer 302 and second padding layer 308. The flex mechanisms 310 are also both retractable and compressible. Each of the plurality of flex mechanisms 310 substantially align with and match the plurality of flexible compression components 306. The flexible compression components 306 are installed into the flex mechanisms 310. This system of dual-layer retractable padding system 300 deflects, shields, and repels any impact on the helmet and the second inner wall padding layer 308. This middle flexing allows the top half of the helmet padding to compress into the bottom helmet therefore taking the impact of an inflicting force. The flexible compression components 306 deflect any impact that is exerted onto the second padding layer 308. In another embodiment, the flexible compression components 306 can include but are not limited to: cavities, air or liquid filled cavities, or springs. In another embodiment, the flexible compression components 306, the head stabilizer component 304, the first direct padding layer 302, the second inner wall padding layer 308, and the flex mechanisms 310 are capable of having sensors and/or transceivers capable of wirelessly communicating with a remote device.

In another embodiment, the top half layers of padding sections can be adjusted against the surface of the player's head and there is a compression system between the first padding layer 302 and second padding layer 308. Since the bottom padding layer is affixed to the interior helmet 100 underside surface which allows any impact that has managed to go through the helmet's exterior tiles 104 and sublayer to all but be neutralized by the flexible mechanisms 310 in between the top and bottom halves.

Figure 32:
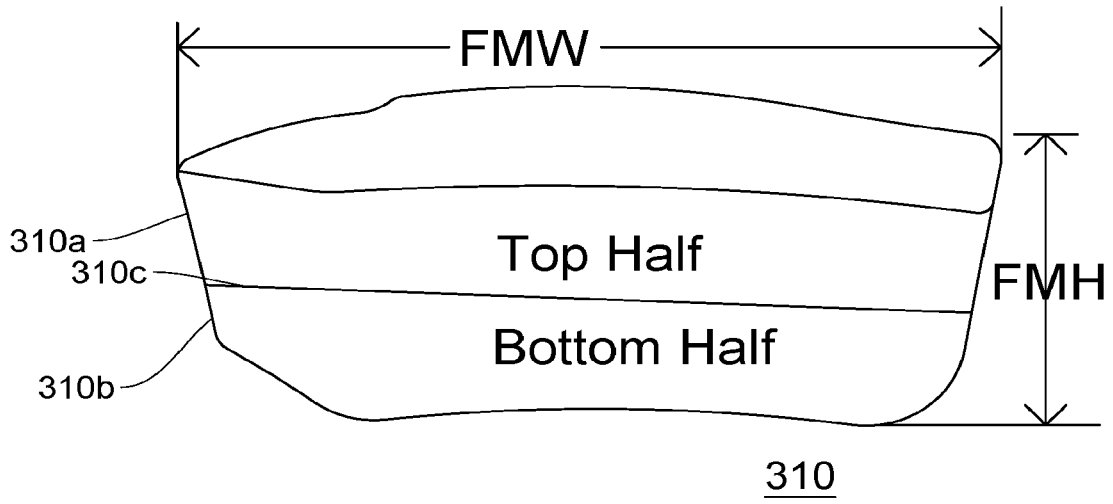
FIG. 32 shows a side view of a flex mechanism 310 having a top half 310*a*, bottom half 310*b* and flex middle separation 310*c*.
Figure 33:
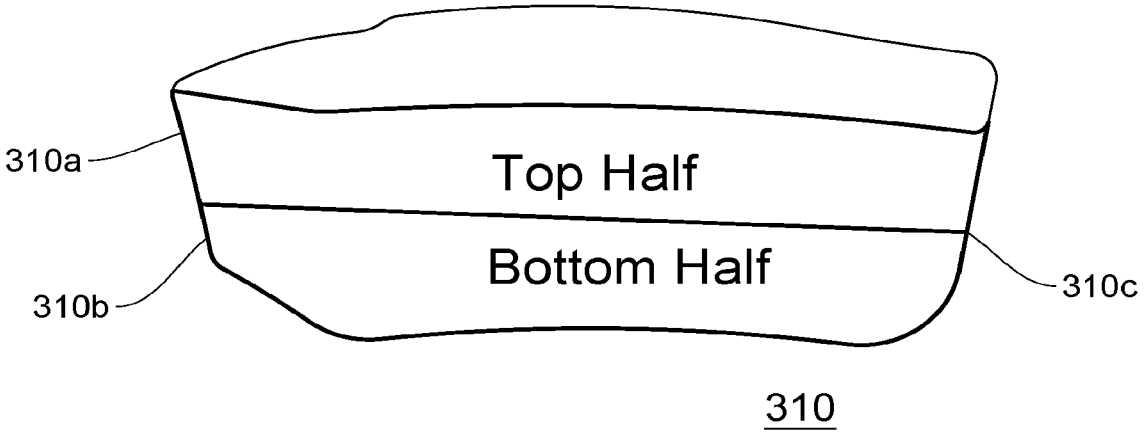
FIG. 33 shows an alternate embodiment of the flex mechanism 310 with the top half 310*a* having greater area dimensions than the bottom half 310*b* enabling the top half 310*a* to compress over the bottom half 310*b*.

FIG. 32 shows a side view of a flex mechanism 310 having a top half 310*a*, bottom half 310*b* and flex middle separation 310*c*. The flex mechanism height (FMH) can be in a range of approximately 0.75 mm and approximately 6.5 mm with it typically being 2.4 mm. The flex mechanism width (FMW) can be in a range of approximately 12.5 mm to approximately 121 mm. FIG. 33 shows an alternate embodiment of the flex mechanism 310 with the top half 310*a* having greater area dimensions than the bottom half 310*b* enabling the top half 310*a* to compress over the bottom half 310*b*.

Figure 34:
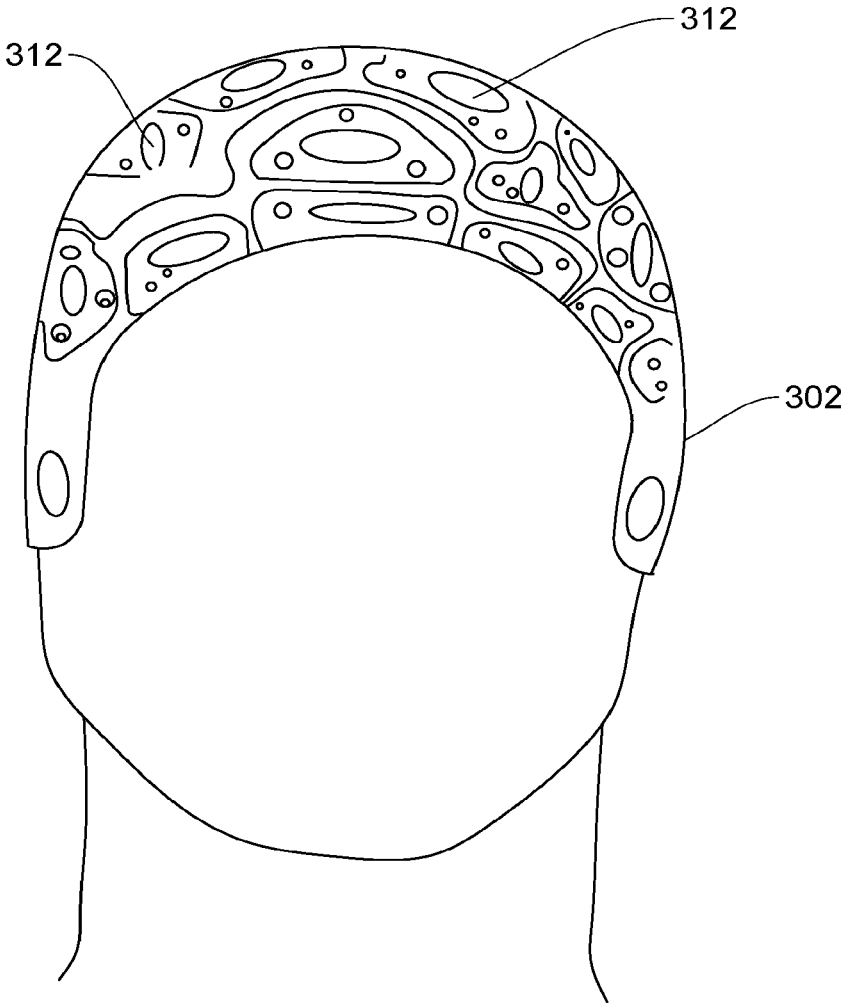
FIG. 34 shows a front view of a first direct padding layer 302 as well as adjustable chambers 312.

FIG. 34 shows a front view of the first direct padding layer 302 as well as adjustable chambers 312. The adjustable chambers 312 can adjust other components within the dual-layer retractable padding system 300 and/or any part of the helmet 100. These adjustments can include the customized fit, temperature, and cooling. In another embodiment, the first direct padding layer 302, the head stabilizer component 304, the flexible compression components 306, a n d the adjustable chambers 312 can individually or collectively be formed in an attachable cap which is attached to the helmet 100.

Figure 35:
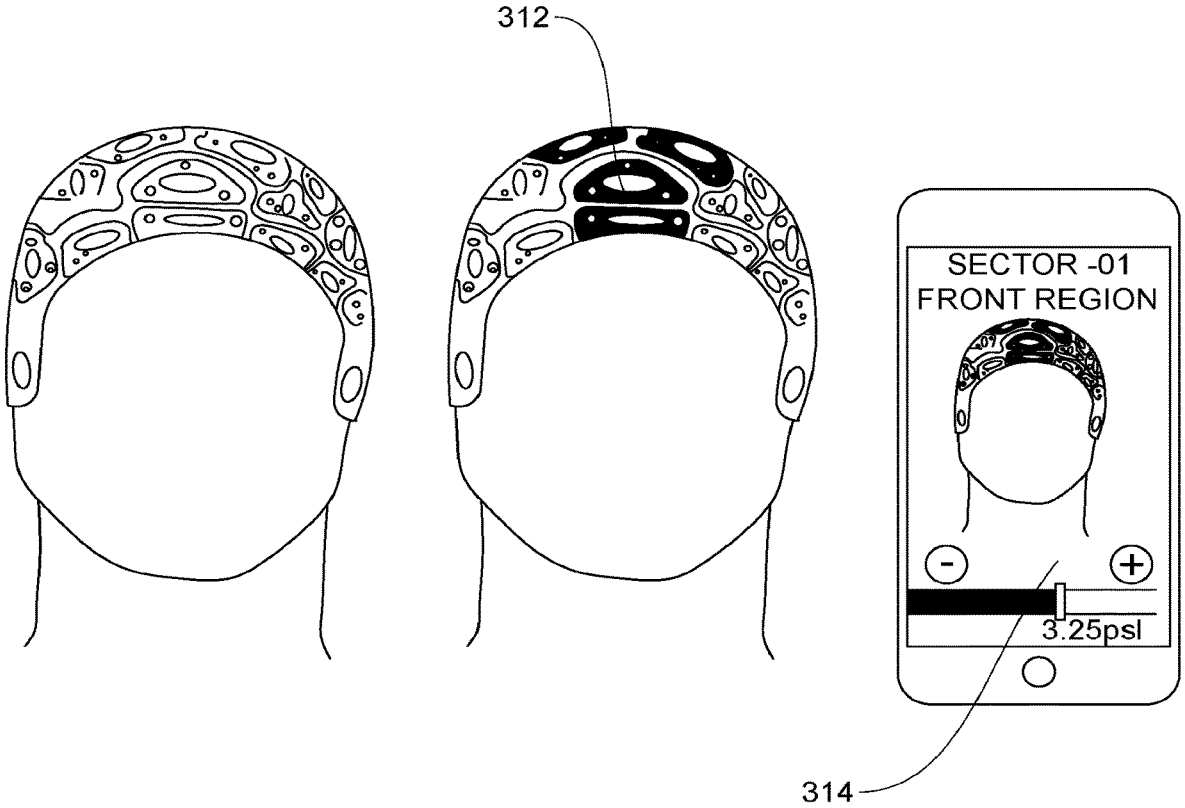
FIG. 35 shows the padding system 300 being wirelessly adjustable by remote mobile device (or computer) with a mobile application.

FIG. 35 shows the system 300 being wirelessly adjustable by remote mobile device (or computer) with a mobile application. The system 300 may be adjusted by users for fit and temperature. In some embodiments, players, and/or users could view, track, record, review, share, download/upload and/or data regarding maintenance, impacts, tackles, hits, force applied, locations of hits, tackles and/or force, as well as statistics of the game, and/or players health, players, safety, and the player's performance, and/or any other received, retrieved, sent, and/or relayed, communicated data, and/or by mobile app technology.

Figure 36:
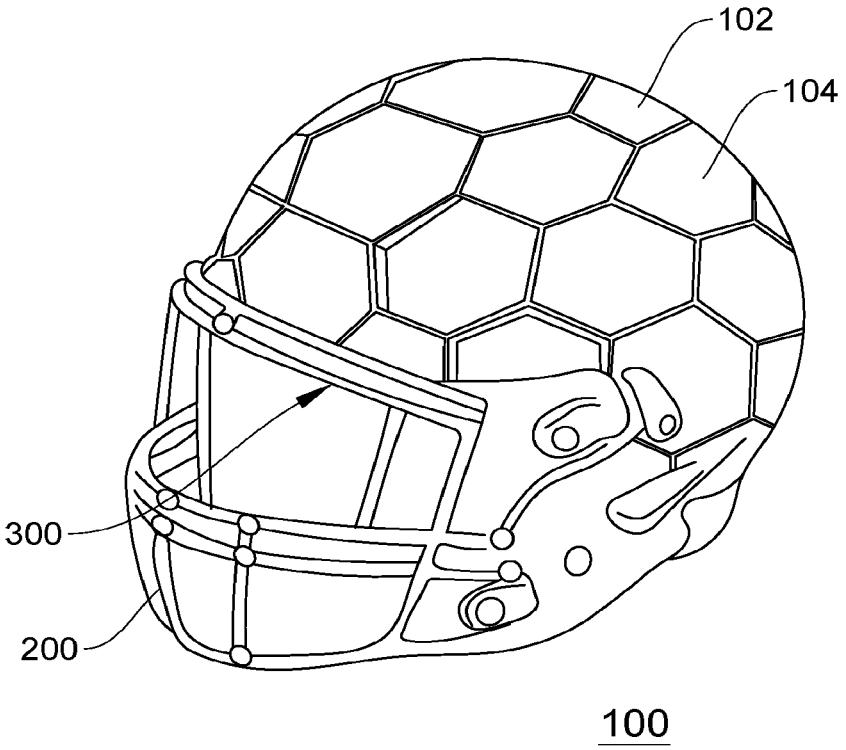
FIG. 36 shows the tile layer 102, face mask 200 and padding system 300 all combined into one helmet 100.

FIG. 36 shows the tile layer 102, face mask 200 and padding system 300 all combined into one helmet 100.

It is understood that wearing helmets of any kind, especially football helmets can inhibit the range of vision a player can effectively utilize. Therefore, in some embodiments, the helmet 100 can contain cameras on the exterior outside walls, and/or as well as the back of the helmet to see opponents, the field of play, and just have different views, and improved visual acuity of their surroundings both peripherally, side to side, as well as behind them to see oncoming opponents, field conditions, play scenarios, routes, scenarios, teammates, and any other visual. abilities. In some embodiments, the interior of the helmet can have screen displays, virtual reality, augmented reality, real time live screens, and monitors that display these camera images, streaming video, first person point of views and/or any other camera information either inside the helmet 100, on the helmet's visor, the helmet's interior wall/surface, or the face mask 200. These camera, virtual reality/augmented reality, real world views, screens, perspectives, information, and data can be transferred to the helmet with audio, visual, and sensory. These notifications can include light up arrows, buzzers, green light buttons, electronic displays, augmented reality, virtual reality, buzzers, sounds, lights, lit panels, and digital screen.

The system 300 further includes a software application 314 that a player can employ to adjust different features of the helmet 100 functions. In some embodiments, the software application 314 allows a player to put on the helmet 100 and adjust specific selected interior helmet pad sections or individual padding snugly against their head while wearing the helmet 100 by pressing the applications button + or – while the adjustable actuators are lengthened and shorted between the top and bottom layer of each section. The calibrated adjustment from the software application 314 can be utilized for tile 104 tautness and elastic cord 124 tautness. The helmet tiles 104 themselves, can individually or collectively, have sensors (e.g., impact sensors) to analyze impacts. In addition, sensors can monitor the psi, force, location, load and damage any hits are made on one or more tiles 104 during a game. This information can be analyzed, shared, and saved on the software application 314 for later. The analysis can include determining any stress points, damage, necessary equipment, and maintenance to the tiles 104. The sensors can be installed into electronic, sensor and/or computerized bases, portals, and/or stations on the helmet 100 in order to be constantly connected and reading data, always streaming and/or connected to a server and/or a computerized device.

The methods, systems, and devices discussed above are examples. Specific details are given in the description to provide a thorough understanding of the embodiments. However, embodiments may be practiced without these specific details. For example, well-known processes, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention. Also, features described with respect to certain embodiments may be combined in various other embodiments. Also, technology evolves and, thus, many of the elements are examples that do not limit the scope of the disclosure to those specific examples.

Some embodiments were described as processes. Although these processes may describe the operations as a sequential process, many of the operations can be performed in parallel or concurrently. In addition, the order of the operations may be rearranged. A process may have additional steps not included in the figures. Also, a number of steps may be undertaken before, during, or after the above elements are considered.

Having described several embodiments, various modifications, alternative constructions, and equivalents may be used without departing from the spirit of the disclosure. For example, the above elements may merely be a component of a larger system, wherein other rules may take precedence over or otherwise modify the application of the invention. Accordingly, the above description does not limit the scope of the disclosure.

It should be noted that the recitation of ranges of values in this disclosure are merely intended to serve as a shorthand method of referring individually to each separate value falling within the range, unless otherwise indicated herein, and each separate value is incorporated into the specification as if it were individually recited herein. Therefore, any given numerical range shall include whole and fractions of numbers within the range. For example, the range "1 to 10" shall be interpreted to specifically include whole numbers between 1 and 10 (e.g., 1, 2, 3, . . . 9) and non-whole numbers (e.g., 1.1, 1.2, . . . 1.9).

The invention claimed is:

1. A helmet system comprising:

a first padding layer made of a stretchy material and configured to be in hugging contact with a user's head, wherein the first padding layer has a plurality of user head stabilizing bands each having flexible compression components; and a shell having an inner wall padding layer affixed to an interior of the shell and capable of surrounding the first padding layer, wherein the inner wall padding layer is made up of flexible mechanisms, wherein the flexible mechanisms are in contact with the flexible compression components to provide deflection from any impact forces received at the shell.

2. The system of claim 1, wherein each of the flex mechanisms having a top half, a flex middle separation and a bottom half.

3. The system of claim 2, wherein the top half has a greater area dimension than the bottom half allowing the top half to compress over the bottom half.

4. The system of claim 1, wherein the first padding layer is configured to hold a plurality of sensor components.

5. The system of claim 1, wherein each of the flexible mechanisms mirrors each of the flexible compression components.

6. The system of claim 1, wherein the flexible compression components are at least one of the group consisting of: air-filled cavities, liquid filled cavities, and springs.

7. The system of claim 1, wherein the first padding layer has adjustable chambers capable of adjusting the flexible compression components.

8. The system of claim 1 wherein the flexible compression components are configured to connect inside cavities in the first padding layer.

9. The system of claim 1, wherein the flex mechanisms are retractable and compressible.

10. The system of claim 1, wherein the first padding layer is capable of being adjusted against the user's head.

* * * * *